US010514205B2

(12) United States Patent
Hjorth et al.

(10) Patent No.: US 10,514,205 B2
(45) **Date of Patent: *Dec. 24, 2019**

(54) HEAT EXCHANGER UNIT

(71) Applicant: Forum US, Inc., Houston, TX (US)

(72) Inventors: Derek Hjorth, The Woodlands, TX (US); John Gaska, Anacortes, WA (US); Dan Godbout, Edmonton (CA)

(73) Assignee: FORUM US, INC., Houston, TX (US)

( * ) Notice: Subject to any disclaimer, the term of this patent is extended or adjusted under 35 U.S.C. 154(b) by 183 days.

This patent is subject to a terminal disclaimer.

(21) Appl. No.: 15/629,563

(22) Filed: Jun. 21, 2017

(65) Prior Publication Data

US 2017/0292789 A1 Oct. 12, 2017

Related U.S. Application Data

(63) Continuation-in-part of application No. 15/477,097, filed on Apr. 2, 2017.
(Continued)

(51) Int. Cl.
*F28D 1/04* (2006.01)
*F28F 9/00* (2006.01)
(Continued)

(52) U.S. Cl.
CPC ..... *F28D 1/0452* (2013.01); *B01F 5/0609* (2013.01); *B01F 15/06* (2013.01);
(Continued)

(58) Field of Classification Search
CPC ..... F28D 1/0452; F28D 2021/004; F28D 2021/0052; B01F 5/0609; B01F 15/06;
(Continued)

(56) References Cited

U.S. PATENT DOCUMENTS 1,833,424 A 11/1931 Jansson
2,060,848 A 11/1936 Boyle
(Continued)

FOREIGN PATENT DOCUMENTS

CA 2415575 A1 1/2002
CA 2963028 A1 4/2016
(Continued)

OTHER PUBLICATIONS

Enerflow 3512 frac truck brochure, L&M Radiator Inc., copyright notice dated 2011 (2 pgs).
(Continued)

*Primary Examiner* — Justin M Jonaitis
(74) *Attorney, Agent, or Firm* — Patterson & Sheridan, L.L.P.

(57) ABSTRACT

Embodiments of the disclosure pertain to an improved heat exchanger unit that includes a frame having a top region, a bottom region, and a plurality of side regions. The unit has a first cooler coupled with the frame proximate to a respective side region and generally parallel to a vertical axis. The unit has a second cooler coupled with the frame proximate to the top region and generally perpendicular to the vertical axis. The unit includes an inner airflow region within the heat exchanger unit, and a first baffle disposed within the inner airflow region.

20 Claims, 7 Drawing Sheets

Related U.S. Application Data

(60) Provisional application No. 62/320,606, filed on Apr. 10, 2016, provisional application No. 62/320,611, filed on Apr. 10, 2016.

(51) Int. Cl.
*B01F 15/06* (2006.01)
*B01F 5/06* (2006.01)
*F28D 21/00* (2006.01)

(52) U.S. Cl.
CPC ..... *F28F 9/001* (2013.01); *B01F 2015/061* (2013.01); *F28D 2021/004* (2013.01); *F28D 2021/0052* (2013.01); *F28F 2009/004* (2013.01); *F28F 2265/28* (2013.01)

(58) Field of Classification Search
CPC ..... B01F 2015/061; F28F 9/001; F28F 2009/004; F28F 2265/28; F28F 9/002; F28F 2280/06; F28F 2265/30; F24H 3/06; E21B 43/26; E21B 43/267; F24F 1/0007; B60K 11/04
See application file for complete search history.

(56) References Cited

U.S. PATENT DOCUMENTS 2,273,869 A 2/1942 Julien
2,382,502 A 8/1945 Philipp
2,505,999 A 5/1950 Smith
3,113,634 A 12/1963 Walters
3,207,258 A 9/1965 D'eustachio
3,384,165 A * 5/1968 Mathews ..... F28B 1/06 165/122
3,572,657 A * 3/1971 Bradley, Jr. ..... F28F 25/04 261/30
3,748,997 A 7/1973 Dean, Jr. et al.
3,759,157 A 9/1973 Larkfeldt et al.
3,762,489 A 10/1973 Proksch et al.
3,848,465 A 11/1974 Howell
4,116,269 A 9/1978 Ikeda
4,139,053 A 2/1979 Schaal
4,266,602 A * 5/1981 White ..... F28D 7/0058 165/124
4,294,595 A 10/1981 Bowerman
4,332,293 A 6/1982 Hiramatsu
4,348,604 A 9/1982 Thode
4,449,664 A 5/1984 Mithuhira et al.
4,481,399 A 11/1984 Greenfield
4,747,275 A 5/1988 Amr et al.
4,821,828 A 4/1989 Schwerzler et al.
4,858,866 A 8/1989 Werner
5,213,152 A 5/1993 Cox
5,238,052 A 8/1993 Chagnot
5,277,655 A 1/1994 Storkan et al.
5,482,113 A 1/1996 Agonafer et al.
5,524,607 A 6/1996 Grohman et al.
5,526,871 A 6/1996 Musser et al.
5,758,860 A 6/1998 Hanazaki et al.
5,879,466 A 3/1999 Creger et al.
5,911,936 A 6/1999 Hanazaki et al.
5,941,303 A 8/1999 Gowan et al.
6,020,737 A 2/2000 Wyss
6,029,345 A 2/2000 Christensen
6,126,681 A 10/2000 Van Duren et al.
6,129,056 A 10/2000 Skeel et al.
6,199,622 B1 3/2001 Mashio et al.
6,240,774 B1 6/2001 Niki et al.
6,286,986 B2 9/2001 Grimland et al.
6,386,273 B1 5/2002 Hateley
6,389,889 B1 5/2002 Ford
6,630,756 B2 10/2003 Kern et al.
6,644,844 B2 11/2003 Neal et al.
6,681,619 B2 1/2004 Alleving et al.
6,736,197 B2 5/2004 Nozaki et al.
6,749,007 B2 6/2004 Ehlers et al.
6,749,901 B1 6/2004 Ghosh et al.
7,210,194 B2 5/2007 Kiern
7,669,485 B2 3/2010 Tang et al.
7,845,413 B2 12/2010 Shampine et al.
7,878,007 B2 2/2011 Campbell et al.
8,188,698 B2 5/2012 Rollins et al.
8,215,833 B2 7/2012 Kouda et al.
8,347,427 B2 1/2013 Klicpera
8,649,931 B2 2/2014 Nishizawa
8,657,227 B1 2/2014 Bayliss et al.
8,764,529 B2 7/2014 Cook et al.
9,103,193 B2 8/2015 Coli et al.
9,109,594 B2 8/2015 Pawlick
9,145,040 B2 9/2015 Markowitz et al.
9,404,417 B2 8/2016 Norrick et al.
9,587,649 B2 3/2017 Oehring
9,945,578 B2 4/2018 Vanberg et al.
9,970,720 B2 5/2018 Vanberg et al.
10,208,983 B2 2/2019 Hjorth et al.
10,281,169 B2 5/2019 Hjorth et al.
2002/0074104 A1 6/2002 Dion
2002/0079150 A1 6/2002 Yorwarth et al.
2003/0183446 A1 10/2003 Shah et al.
2003/0192737 A1 10/2003 Han et al.
2004/0053031 A1 3/2004 Beaufils et al.
2004/0200598 A1 10/2004 Hitt et al.
2005/0159846 A1 7/2005 Van Ostrand et al.
2005/0236150 A1 10/2005 Chagnot et al.
2006/0042276 A1 3/2006 Doll et al.
2006/0042278 A1 3/2006 Ludwig et al.
2007/0023172 A1 2/2007 Obrist et al.
2008/0017723 A1 1/2008 Johnson et al.
2008/0065245 A1 3/2008 Tang et al.
2008/0256963 A1 10/2008 Mettier
2009/0219451 A1* 9/2009 Birleson ..... H03D 7/161 348/731
2010/0028134 A1 2/2010 Slapak et al.
2010/0115771 A1 5/2010 Johnson et al.
2011/0066298 A1 3/2011 Francino et al.
2011/0192578 A1 8/2011 Lang et al.
2011/0282619 A1 11/2011 Laursen et al.
2012/0168113 A1 7/2012 Karamanos
2012/0247712 A1 10/2012 Schertz et al.
2013/0022432 A1 1/2013 Spitler
2014/0008074 A1 1/2014 Nevison
2014/0014426 A1 1/2014 Lauper, Jr. et al.
2014/0056729 A1* 2/2014 Pawlick ..... F04B 53/08 417/234
2014/0262147 A1* 9/2014 Pawlick ..... F28F 9/001 165/67
2014/0345835 A1 11/2014 Hwang et al.
2014/0365195 A1 12/2014 Lahiri et al.
2015/0047811 A1 2/2015 Kappelman et al.
2015/0070007 A1 3/2015 Kurniawan
2015/0251521 A1 9/2015 Brauer et al.
2015/0252661 A1 9/2015 Glass
2015/0343892 A1 12/2015 Kolhouse et al.
2015/0362207 A1 12/2015 Abiprojo et al.
2016/0025536 A1 1/2016 Madsen
2016/0146487 A1 5/2016 Zywiak et al.
2016/0186649 A1 6/2016 Rollinger et al.
2016/0305865 A1 10/2016 Silva et al.
2017/0016649 A1 1/2017 Ace
2017/0096885 A1 4/2017 Oehring et al.
2017/0234631 A1 8/2017 Anderl et al.
2017/0292735 A1 10/2017 Hjorth et al.
2017/0292736 A1 10/2017 Hjorth et al.
2017/0292800 A1 10/2017 Vanberg et al.
2017/0292801 A1 10/2017 Vanberg et al.
2017/0292803 A1 10/2017 Vanberg et al.
2017/0294103 A1 10/2017 Vanberg et al.
2017/0294366 A1 10/2017 Vanberg et al.
2018/0003532 A1 1/2018 Vanberg et al.
2018/0209752 A1 7/2018 Vanberg et al.
2018/0209827 A1 7/2018 Vanberg et al.

(56) References Cited

U.S. PATENT DOCUMENTS

FOREIGN PATENT DOCUMENTS

| | | | |
|---|---|---|---|
| DE | 10306786 | A1 | 8/2003 |
| WO | 2016079674 | A1 | 5/2016 |
| WO | WO2016079674 | | 5/2016 |

OTHER PUBLICATIONS

World Academy of Science, Engineering and Technology, vol. 6 Nov. 28, 2012, "CFD Modeling of a Radiator Axial Fan for Air Flow Distribution", date of publication indicated as 2012 (6 pgs).
Canadian Office Action dated Jul. 6, 2018 for Application No. 2,963,572.
Canadian Office Action dated Apr. 26, 2018 for Application No. 2,963,568.
Canadian Office Action dated Feb. 8, 2019 for Application No. 2,969,703.
Canadian Office Action dated Jul. 25, 2018 for Application No. 2,971,746.
Canadian Office Action dated Oct. 12, 2018 for Application No. 2,979,845.
Canadian Office Action dated Nov. 15, 2018 for Application No. 3,022,969.
Canadian Office Action dated Feb. 12, 2019 for Application No. 3,030,718.
International Search Report and Written Opinion dated Jul. 5, 2018 for Application No. PCT/IB2018/052269.
International Search Report and Written Opinion dated Dec. 17, 2018 for Application No. PCT/IB2018/057065.

* cited by examiner

HEAT EXCHANGER UNIT

CROSS-REFERENCE TO RELATED APPLICATIONS

This application is a continuation-in-part of U.S. non-provisional application Ser. No. 15/477,097, filed Apr. 2, 2017, which claims the benefit under 35 U.S.C. § 119(e) of U.S. Provisional Patent Application Ser. No. 62/320,606, filed on Apr. 10, 2016, and of U.S. Provisional Patent Application Ser. No. 62/320,611, filed on Apr. 10, 2016. The entirety of each application is incorporated herein by reference in entirety for all purposes.

INCORPORATION BY REFERENCE

The subject matter of co-pending U.S. non-provisional application Ser. No. 15/591,076, filed May 9, 2017, and Ser. Nos. 15/477,097 and 15/477,100, each filed Apr. 2, 2017, is incorporated herein by reference in entirety for all purposes. One or more of these applications may be referred to herein as the "Applications".

BACKGROUND

Field of the Disclosure

This disclosure generally relates to a heat exchanger unit with characteristics of improved: airflow, monitoring, noise reduction, cooling efficiency, and/or structural integrity. In embodiments, the disclosure relates to a heat exchanger unit used in connection with equipment found in an industrial setting. In particular embodiments, the heat exchanger unit may be used for cooling various utility fluids used with a heat generating device, such as an engine, a pump, or a genset.

Background of the Disclosure

Whether its refrigeration, hot showers, air conditioning, and so on, the function of heating and cooling is prevalent in today's residential and industrial settings. One area of relevance is the oil and gas industry, including exploration, upstream, and downstream operations where the ability to heat and/or cool is critical. Upstream operations can include drilling, completion, and production, whereas downstream operations can include refining and other related hydrocarbon processing, all of which utilize a vast amount of process equipment including that which provide heat transfer. To be sure, the background of the disclosure is relevant elsewhere, but for brevity discussion is focused on O&G.

As the modern world continues to experience growth in population, it similarly continues to experience an increase in energy demand and consumption, and the oil and gas industry needs to respond accordingly. Although 'green' energy has experienced a gain in popularity, the dominant source of energy remains fossil fuels. Driven by demand and high prices for fossil fuels, the U.S. energy sector experienced a boom in the late 2000's and into the early 2010's, contributing to expansion in exploration and production across the country.

Quite unexpectedly various global economic factors resulted in a rapid turnaround in demand and a decrease in profit margin that left many industry related companies vying to remain in business. This has resulted in consolidation and innovation, as the reality of likely never again seeing the record highs associated with the price of oil sets in. To remain competitive, companies have begun looking at how they can be successful and profitable with a margin based on an oil price in a range of about $30-$50 per barrel.

A particular segment in the upstream area of oil and gas production pertains to fracing. Now common, fracing includes the use of a plug set in a wellbore below or beyond a respective target zone, followed by pumping or injecting high pressure frac fluid into the zone. The frac operation results in fractures or "cracks" in the formation that allow valuable hydrocarbons to be more readily extracted and produced by an operator, and may be repeated as desired or necessary until all target zones are fractured.

The injection fluid, which may be mixed with chemicals, sand, acid, etc., may be pressurized and transported at high rate via one or more high pressure frac pumps, typically driven by diesel combustion engines.

A conventional frac pump trailer unit includes those manufactured or provided by NOV, Haliburton, Magnum, Weatherford, and the like. See http://www.nov.com/Well_Service_and_Completion/Stimulation_Equipment/Fracturing_Pump_Units.aspx.

The necessity of fracturing has progressively increased as production rates on new wells continue to decline. It is believed by some that at least 90 percent of all future wells in North America will require some degree of fracturing to increase production results, with a majority of these operations occurring in shale gas formations.

As demand continues to rise, producers have moved to unconventional sources such as the Barnett Shale, which for the first time resulted in wide reliance on horizontal drilling, leading to an increase on pumping pressures and operating times. Horizontal drilling and its associated multistage fracturing techniques are now the norm as shale formations have become the leading source of natural gas in North America. This harsher pumping environment demands stronger pumps capable of operating at extreme pressures and extended pumping intervals.

The frac pump is now part of a pumping system (or skid unit, etc.) that is typically self-contained on a transportable system, such as a trailer unit. The system components include the engine and the frac pump, as well as a radiator (or cooler, heat exchanger, etc.). Today's pumps are capable of producing 2500 BHP @ 1900 rpm while operating in standard pressure pumping well service operations in ambient conditions of about 0° F. to 125° F., and can provide upwards of 15,000 psi injection pressure at a working rate of 17 bpm. The frac pump provides pressurized fluid into well(s) via transfer (injection) lines.

But there are several drawbacks to this modern equipment, as outlined the Applications.

A related area of relevance pertains to a blender unit that creates the frac slurry, and transfer to unit 105. FIG. 1 illustrates a blender unit 160 that may be mobile, such as via skid (or chassis, trailer, etc.) 161, and is known by one of skill in the art for making a slurry of particulate material, such as sand blended with fracutring fluid, proppant, and so forth. The blender unit 160 usually has one or more blending tubs 162, from which the slurry is discharged and transferred via a booster pump 164 to a frac pump (113, FIG. 1B), which then injects the slurry into a well and into the producing zones.

Material (e.g., sand) may be provided to the tubs 162 through one or more screw augers 163. The augers 163 may be may be powered simultaneously or separately, depending on the required amount of particulate matter. The screw augers 163 and the booster pump 164 may be powered by a heat generating device 103*b*, either of which may be a diesel engine or other comparable driver.

The blender unit 160 may have a main control system, which may be located in a cab 166 of the trailer 161. The control system may, among other things, control the auger speeds, booster pump speed, engines, and other related equipment. A suitable computer may be used to control the operation of the system so that a desired slurry is achieved. As one of skill would appreciate, the heat generating device (s) 103*b* may be coupled with a respective radiator(s) 100*b* so that necessary cooling of service fluids is possible. Radiator 100*b* alas has the inherent problems described herein related to noise, orientation, size, integrity, fouling, and so forth.

One or more of these concerns is just as valid to non-oilfield related heat exchangers. The operation or setting may be a construction site, a building, a water treatment plant, a manufacturing facility, or any other setting whereby a heat exchanger is used for heat transfer, such as to cool (or heat) a utility fluid F that is used with the HGD. In an analogous manner HGD's associated with a residential setting may also have similar concerns. In other aspects, it is becoming more and more common that an industrial setting or operation is adjacent or proximate to a residential setting.

Common settings are nothing short of challenging in the sense that in many instances operations and processes (and related equipment) are exposed to environmental conditions, such as extreme heat, cold, wind, and dust (including natural amounts of particulate, as well as that caused by the operation of equipment and vehicles).

It is routine to have (indeed, need) some type of heat exchange ability in such settings. As set forth in U.S. Ser. No. 15/477,097, an example operation in an industrial setting may include one or more frac pump units. Each unit is typically operable with a pump and engine mounted or otherwise disposed thereon, as well as a radiator (or analogously referred to as cooler, heat exchanger, etc.). As mentioned before, equipment like this must be rugged and durable in order to have long-term operational capacity and effectiveness.

The radiator is configured for cooling one or more hot service fluids associated with the equipment of the frac pump unit, such as lube oil or jacket water. The radiator typically includes a 'core' of stacked fins, with one part of the core providing a flow are for the service fluid(s), while another part of the core is provides a proximate, albeit separate, flow area for ambient air. A fan is used to blow or pull air through the stacked fins, the air being a low or moderate enough temperature to cool the service fluid, which is then recirculated in a loop.

The stacked fins often have a configuration that is tantamount to an extensive amount of small air passageways proximate to (albeit separate from) service fluid passageways, whereby the air and the service fluid can 'exchange heat' via the surface material of the stacked fins between the passageways (e.g., aluminum).

Over time airborne dirt in and other particulate in the air will begin to deposit on the air intake side (and elsewhere), resulting in a fouled radiator. Fouling can seriously deteriorate the capacity of the surface of the fins to transfer heat under the conditions for which they were designed. Among other problems, the fouling layer has a low thermal conductivity which increases the resistance to heat transfer and reduces the effectiveness of heat exchangers. In addition, fouling reduces the cross-sectional area in the passageways, which causes an increase in pressure drop across a heat exchanger.

Radiator fouling affects both capital and operating costs of heat exchangers (and overall processes). Higher capital expenditures include that for excess surface area (for heat transfer), extra space, and transport and installation costs. Operating expenditures include that for energy losses due to the decrease in thermal efficiency, increases in the pressure drop through process equipment, and production losses during planned and unplanned plant shutdowns for fouling cleaning.

Moreover, government emissions regulations are forcing engine manufacturers and their customers to reduce emissions from reciprocating engines. Current solutions involve returning the exhaust through heat exchange, which elevates combustion temperature and puts significantly more heat into the cooling system. Tier 4 Final (US and CA) Emission regulations come into effect in 2017 & 2020 will force end users into significant equipment redesign industry wide. See, e.g., http://www.assocpower.com/eqdata/tech/US-EPA-Tier-Chart_2004-2017.php, for general reference.

In summary, fouling of heat transfer surfaces is one of the most important problems in heat transfer equipment. Some have described fouling as the major unresolved problem in heat transfer. Equipment operators world-wide are also trying to reduce maintenance costs. One of the highest maintenance costs any piece of equipment has is cooling system maintenance.

And yet despite these detriments, consideration of improved remediation or management techniques have been largely ignored and unchanged. Conventional techniques include mitigation (such as upstream filtering) and chemical treatment.

Mechanical cleaning is also used, but only during predetermined periodic intervals, namely during a planned shutdown or when an exchanger reaches a point of failure and is no longer operable. This approach relies on extensive cost and resource being allocated toward the antiquated philosophy of operational redundancy.

There is a need in the art to overcome deficiencies and defects identified herein. There is a need in the art to reliably monitor fouling of a radiator. There is a need in the art to provide a real-time warning indication about fouling conditions of a radiator.

There is a need in the art for a monitoring system that is durable for use in outdoor and other difficult environmental conditions. There is a need in the art for a monitoring system capable of high degree of sensing accuracy, yet impervious to or otherwise able to withstand external conditions.

There is a need in the art for a method of doing business that includes monitoring and servicing of radiators, especially when the radiator reaches various stages of fouling or provides other indication requiring attention. There is a need in the art to clean a fouled radiator with little or no downtime.

There is a need in the art for a monitoring module that can be retrofitted to any existing heat exchanger, including of great importance to a heat exchanger that has one or more sides (or surfaces) exposed to ambient air.

There is a particular need in the art for a monitoring system that is readily adaptable and compatible to radiators associated with different pieces of heat generating equipment, such as an engine, a motor, a pump, or a genset useable in a wide range of settings.

There is a need in the art to overcome deficiencies and defects identified herein. There is a particular need in the art for a heat exchanger that is readily adaptable and compatible to different pieces of heat generating equipment, such as an engine, a motor, a pump, or a genset, and is useable in a wide range of settings.

There is a need in the art to be able to reduce pressure drop, whereby airflow through a heat exchanger can be streamlined and increased. There is a need to reduce sound emission from a heat exchanger so that it may satisfy regulatory limitations or be suitable for use in or proximate to a residential setting.

There is a need in the art for a heat exchanger that can accommodate spatial constraints, and is lighter in weight. There is a need in the art for a heat exchanger that has improved or reduced sound emissions. There is a need in the art for a heat exchanger that improves cooling efficiency. There is a need in the art for a heat exchanger with improved structural integrity, including the ability to withstand or tolerate thermal expansion and hot welding temperatures.

SUMMARY

Embodiments of the disclosure pertain to a heat exchanger unit that may include a frame comprising a top region, a bottom region, and a plurality of side regions. There may be a first cooler coupled with the frame proximate to a respective side region and generally parallel to an axis. There may be a second cooler coupled with the frame proximate to the top region and generally perpendicular to the axis. There may be an inner airflow region within the heat exchanger unit. There may be a first baffle disposed within the inner airflow region. The baffle may be oriented a first angle to the axis.

Other embodiments of the disclosure pertain to a blender skid for creating a frac fluid mixture. The blender skid may include one or more of a blender; a first diesel engine; and a heat exchanger unit configured to cool at least one service fluid transferable between the heat exchanger unit and the first diesel engine.

The heat exchanger unit of the blender skid may include an axis; and a frame comprising a top region, a bottom region, and a plurality of side regions. There may be a first cooler coupled with the frame proximate to a respective side region and generally parallel to the axis. There may be a second cooler coupled with the frame generally perpendicular to the orientation of the first cooler.

The unit of the skid may include an inner airflow region within the heat exchanger unit; and a first baffle disposed within the inner airflow region at a first angle to the axis.

Yet other embodiments of the disclosure pertain to a heat exchanger unit that may include a frame comprising a top region, a bottom region, and a plurality of side regions. The unit may include a first cooler coupled with the frame proximate to a respective side region and generally parallel to an axis. The unit may include a second cooler coupled with the frame proximate to the top region and generally perpendicular to the axis. The unit may include a first fan mounted to the frame external to a first side of the first cooler. The unit may include an inner airflow region therein. The unit may include a first baffle disposed within the inner airflow region, and at a first angle to the vertical axis.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1:
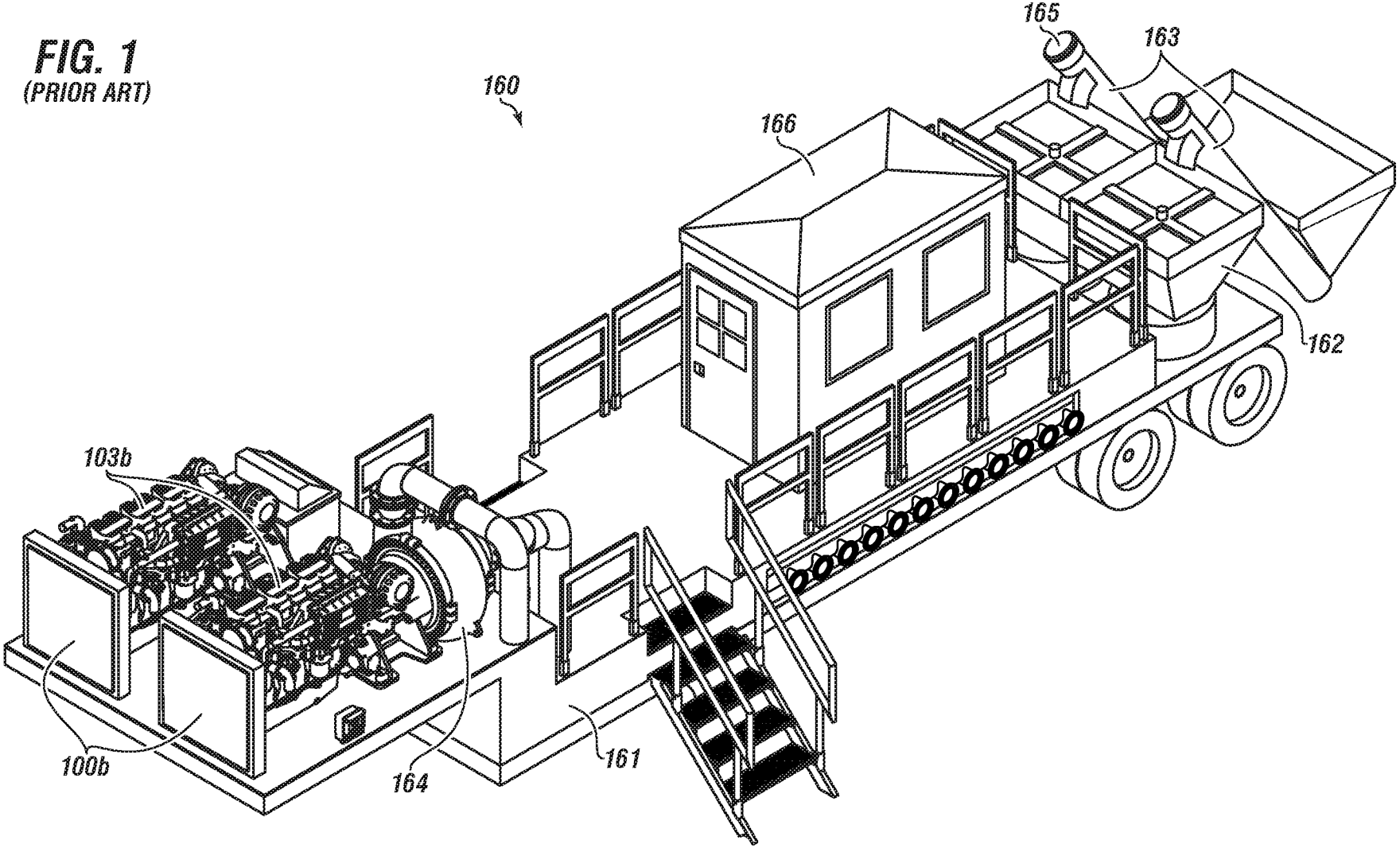
FIG. 1 (PRIOR ART)
FIG. 1 shows an isometric view of a mobile blender unit.

Herein disclosed are novel apparatuses, systems, and methods that pertain to an improved heat exchanger, details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted to existing machines and systems.

Terms

The term "noise" as used herein can refer to a sound, including an undesirous sound.

The term "sound" as used herein can refer to a vibration(s) that travels through the air or another medium, and can be detectable or discernable to the human ear or an instrument. Sound can be referred to as a pressure wave resulting in pressure variations. A loud noise usually has a larger pressure variation and a weak one has smaller pressure variation. The more readily referred to measurement of loudness of sound is a logarithmic scale of Pascals, the decibel (dB). Sound and noise can be interchangeable, or have comparable meaning.

The term "noise absorbing material" as used herein can refer to a material having a physical characteristic of being able to reduce amplitude of a noise or sound. That is, reduce a pressure variation. 'Noise absorbing' can be interchangeable to noise reduction, noise absorbent, abatement by absorbing, and so forth. The material can be a fibrous material, such as mineral wool.

The term "noise barrier" can refer to a material or component capable of stopping noise from passing therethrough. In aspects, a noise barrier material can be adhered (such as glued) to a component. The noise barrier material can be vinyl.

The term "frequency" as used herein can refer to the rate at which a vibration (of a respective sound) occurs over a period of time. The number of pressure variations per second is called the frequency of sound, and is measured in Hertz (Hz) which is defined as cycles per second. The higher the frequency, the more high-pitched a sound is perceived.

The term "dominant acoustic frequency" can refer to a respective sound that is most discernable or noticeable to a human ear or instrument.

The term "engine" as used herein can refer to a machine with moving parts that converts power into motion, such as rotary motion. The engine can be powered by a source, such as internal combustion.

The term "motor" as used herein can be analogous to engine. The motor can be powered by a source, such as electricity, pneumatic, or hydraulic.

The term "drive" (or drive shaft) as used herein can refer to a mechanism that controls or imparts rotation of a motor(s) or engine(s).

The term "pump" as used herein can refer to a mechanical device suitable to use an action such as suction or pressure to raise or move liquids, compress gases, and so forth. 'Pump' can further refer to or include all necessary subcomponents operable together, such as impeller (or vanes, etc.), housing, drive shaft, bearings, etc. Although not always the case, 'pump' can further include reference to a driver, such as an engine and drive shaft. Types of pumps include gas powered, hydraulic, pneumatic, and electrical.

The term "frac pump" as used herein can refer to a pump that is usable with a frac operation, including being able to provide high pressure injection of a slurry into a wellbore. The frac pump can be operable in connection with a motor or engine. In some instances, and for brevity, 'frac pump' can refer to the combination of a pump and a driver together.

The term "frac truck" as used herein can refer to a truck (or truck and trailer) useable to transport various equipment related to a frac operation, such as a frac pump and engine, and a radiator.

The term "frac operation" as used herein can refer to fractionation of a downhole well that has already been drilled. 'Frac operation' can also be referred to and interchangeable with the terms fractionation, hydrofracturing, hydrofracking, fracking, fraccing, and frac. A frac operation can be land or water based.

The term "radiator" can also be referred to or interchangeable with the term 'heat exchanger' or 'heat exchanger panel'. The radiator can be a heat exchanger used to transfer thermal energy from one medium to another for the purpose of cooling and/or heating.

The term "cooler" as used herein can refer to a radiator made up of tubes or other structure surrounded by fins (or 'core') that can be configured to extract heat from a fluid moved through the cooler. The term can be interchangeable with 'heat exchanger panel' or comparable. Heat can also be exchanged to another fluid, such as air.

The term "cooling circuit" as used herein can refer to a cooler and respective components.

The term "core" as used herein can refer to part of a cooler, and can include multiple layers of fins or fin elements.

The term "heat exchanger unit" as used herein can refer to a device or configuration that uses multiple coolers along with other components, such as a fan, mounts, tubing, frame, and so on. The heat exchanger unit can be independent and standalone or can be directly mounted to a heat generating device. The heat exchanger unit can be operable to pull (draw) ambient air in through the coolers in order to cool one or more service fluids. The heated air is moved or blown out as a waste exhaust stream.

The term "heat generating device" (or sometimes 'HGD') as used herein can refer to an operable device, machine, etc. that emits or otherwise generates heat during its operation, such as an engine, motor, a genset, or a pump (including the pump and/or respective engine). The HGD can be for an industrial or a residential setting.

The term "genset" (or generator set) as used herein can refer to a 'diesel generator' or the combination of a diesel engine (or comparable) and an electric generator. The genset can convert the mechanical energy to electrical energy.

The term "baffle" as used herein can refer to a component used within a heat exchanger unit to help regulate or otherwise improve airflow therethrough. The baffle can be one-piece in nature or configured from a number of subcomponents connected together. There can be a plurality of baffles, including various 'sets' of baffles. The baffle(s) can include noise absorbing material.

The term "utility fluid" as used herein can refer to a fluid used in connection with the operation of a heat generating device, such as a lubricant or water. The utility fluid can be for heating, cooling, lubricating, or other type of utility. 'Utility fluid' can also be referred to and interchangeable with 'service fluid' or comparable.

The term "mesh" as used herein can refer to a material made of a network of wire or thread, or an interlaced/interconnected structure.

The term "brazed" as used herein can refer to the process of joining two metals by heating and melting a filler (alloy) that bonds the two pieces of metal and joins them. The filler may have a melting temperature below that of the two metal pieces.

The term "welded" as used herein can refer to a process that uses high temperatures to melt and join two metal parts, which are typically the same. Such a process can refer to different types of welding, including TIG weld, metal inert gas (MIG), arc, electron beam, laser, and stir friction.

The term "deformable" as used herein can refer to an ability for a material to experience a change in shape from an original shape, such as from a force, and then substantially return to the original shape.

The term "machining" ("machine", "machined", etc.) as used herein can refer to re-machining, cutting, drilling, abrading, cutting, drilling, forming, grinding, shaping, etc. of a target piece.

The term "effective mass" as used herein can refer to the mass of part of a component, or partial mass of the component. For example, a core may have a core end, and the core end may have an effective mass, or a core end mass. The mass of the core end is less than the mass of the whole core.

The term "mounted" can refer to a connection between a respective component (or subcomponent) and another component (or another subcomponent), which can be fixed, movable, direct, indirect, and analogous to engaged, coupled, disposed, etc., and can be by screw, nut/bolt, weld, and so forth.

The term "sensor" as used herein can refer to a device that detects or measures a physical property and records, indicates, or otherwise responds to it. The output of a sensor can be an analog or digital signal.

The term "airflow sensor" as used herein can refer to a sensor used to detect or otherwise be able to measure (directly or indirectly) airflow.

The term "microprocessor" as used herein can refer to a logic chip or a computer processor on a microchip. The microprocessor may have most or all central processing unit (CPU) functions.

The term "microcontroller" as used herein can refer to a CPU with additional function or structure, such as RAM, ROM, and or peripherals like I/O all embedded on a single chip.

The term "voltage regulator" as used herein can refer to a device or logic circuit that maintains a constant voltage level.

The term "computer readable medium" (CRM) as used herein can refer to any type of medium that can store programming for use by or in connection with an instruction execution system, apparatus, or device. The CRM may be, for example, a device, apparatus, or system based on electronic, magnetic, optical, electromagnetic, or semiconductor function. By way of further example, the CRM may include an electrical connection (electronic) having one or more wires, a portable computer diskette (magnetic or optical), a random access memory (RAM) (electronic), a read-only memory (ROM) (electronic), an erasable programmable read-only memory (EPROM, EEPROM, or Flash memory) (electronic), an optical fiber (optical), and a portable compact disc memory (CDROM, CD R/W) (optical).

The term "solid data storage" as used herein can refer to a CRM having an array of data, including one or more lookup tables (LUT).

The term "lookup table" (or LUT) as used herein can refer to a data array that may include predetermined or reference data useable for comparison. A LUT(s) can be stored in static program storage, including solid data storage.

The term "Wi-Fi module" as used herein can refer to a device or logic circuit that provides ability for a microcontroller to communicate data to a network, as well as update firmware and code inside the microcontroller.

The term "GSM module" as used herein can refer to a device or logic circuit that provides ability for a microcontroller to communicate data or signal to a Global System for Mobile communication (GSM). The microcontroller can thus initiate, for example, the sending of information in a SMS message.

The term "CAN-Bus module" as used herein can refer to a message-based protocol that allows a microcontroller to communicate with other devices, which can include industrial or large pieces of equipment associated with a respective microcontroller.

The term "blender unit" as used herein can refer to one or more pieces of equipment arranged together for the purpose of forming a frac slurry. The blender unit can have one or more engines associated and operably engaged with a respective cooler. The blender unit can, but need not have to be, mobile.

Embodiments herein pertain to a heat exchanger unit that may include a vertical axis; and a frame. The frame may include a top region, a bottom region, and a plurality of side regions. A first cooler may be coupled with the frame proximate to a respective side region. The first cooler may be mounted with its long axis that may be generally parallel to the vertical axis.

The heat exchanger unit may include a second cooler coupled with the frame. The second cooler may be coupled proximate to the top region. The second cooler may coupled and oriented in a manner whereby its long axis may be generally perpendicular to the vertical axis.

The heat exchanger unit may include an inner airflow region therein. There may be a first baffle disposed within the inner airflow region, and at a first angle to the vertical axis.

The heat exchanger unit may include a third cooler. The third cooler may be coupled with the frame proximate to a respective side region. The third cooler may be coupled adjacent the first cooler. The third cooler may be coupled and oriented with its long axis generally parallel to the vertical axis. The heat exchanger unit may include a fourth cooler.

The fourth cooler may be coupled proximate to the top region, and may be adjacent the second cooler. The fourth cooler may coupled and oriented in a manner whereby its long axis may be generally perpendicular to the vertical axis.

The heat exchanger unit may include a second airflow region partitioned from the inner airflow region. The second airflow region may be associated with the third cooler and the fourth cooler. There may be a second baffle disposed within the second airflow region. The second baffle may be coupled and oriented a second angle to the vertical axis. The first angle and/or the second angle may be in the range of about 30 degrees to about 60 degrees. The first angle and the second angle may be at least substantially the same.

Either of the first baffle and the second baffle may include a sound absorbing material. In aspects, the sound absorbing material may be mineral wool or other comparable material.

The heat exchanger unit may include at least one fan configured to operate and produce a point source dominant acoustic frequency. Sound absorbing material may be capable to reduce the point source dominant acoustic frequency by at least 10 dB.

The heat exchanger unit may include a first fan mounted to the frame external to a first side of the first cooler. There may also be a second fan mounted to the frame external to a first side of the third cooler. Each of the first fan and the second fan may have an axis of rotation substantially perpendicular to the vertical axis.

One or more coolers of the exchanger unit may be configured to permit airflow to pass therethrough. In aspects, operation of the first fan and/or the second fan may result in airflow through one or more respective coolers and airflow regions, and out of an outlet of the HX unit.

The HX unit may include a first sidewall; a second sidewall; a back wall; and a bottom. At least one of the first sidewall, the second sidewall, the back wall, and the bottom may have a sound absorbing material. At least one of the first sidewall, the second sidewall, the back wall, and the bottom may have a vinyl-based material. In aspects, at least one of the first sidewall, the second sidewall, the back wall, and the bottom may have an inner layer of sound absorbing material; and an exterior layer of a vinyl-based material.

The heat exchanger may include a monitoring module proximately coupled to at least one of the first cooler, the second cooler, the third cooler, and the fourth cooler. The monitoring module may include: a cover panel; at least one sensor coupled with the cover panel; at least one controller housing coupled with the cover panel; and a microcontroller disposed within the controller housing and in opreable communication with at least one sensor.

At least one sensor of the module may include a rotating member configured to generate a system signal proportional to an amount of rotation of the rotating member. The microcontroller may be provided and programmed with computer instructions for processing the system signal. In aspects, the system signal may pertain to an amount of fouling.

The monitoring module may include a plurality of sensors. One or more of the plurality of sensors may be in operable communication with the microcontroller. At least one of the plurality of sensors may include a plurality of blades radially extending from the respective rotating member.

The monitoring module may include one or more of: a solid data storage, a Wi-Fi module, a GSM module, and a CAN-Bus module being disposed within the controller housing and in operable communication with the microcontroller. The microcontroller may be provided with computer instructions for communicating with one or more of the solid data storage, the Wi-Fi module, the GSM module, and the CAN-Bus module.

Embodiments of the disclosure pertain to a blender skid for creating a frac fluid mixture that may include a blender (or tub); a heat generating device; and a heat exchanger unit configured to cool at least one service fluid transferable between the heat exchanger unit and the heat generating device.

The heat exchanger unit may include a vertical axis; and a frame having a top region, a bottom region, and a plurality of side regions. The unit may include a first cooler coupled with the frame proximate to a respective side region. The first cooler may be mounted in a manner to have its long axis generally parallel to the vertical axis. The unit may include a second cooler coupled with the frame.

In aspects, the second cooler may have its long axis generally perpendicular to the long axis of the first cooler. Accordingly, the second cooler may be coupled proximate to the top region. In other aspects, the second cooler may have its long axis generally parallel to the long axis of the first cooler. Accordingly, the second cooler may be coupled proximate to one of the plurality of side regions.

The heat exchanger unit may include an inner airflow region within the heat exchanger unit. There may be a first baffle disposed within the inner airflow region, and at a first angle to the vertical axis. The heat exchanger unit may include a second baffle disposed therein. The second baffle may be disposed and oriented at a second angle to the vertical axis. The first angle and the second angle may be in the range of 30 degrees to 60 degrees. In aspects, either of the first baffle and the second baffle may include or otherwise have a sound absorbing material.

The heat exchanger unit of the skid may include a first sidewall; a second sidewall; a back wall; and a bottom.

At least one of the first sidewall, the second sidewall, the back wall, and the bottom further may include: an inner layer of sound absorbing material; and an exterior layer of a vinyl-based material.

Embodiments of the disclosure pertain to a method for monitoring a heat exchanger unit that may include one or more of coupling the heat exchanger unit with at least heat generating device; associating a monitoring module with an airflow side of at least one cooler; performing an action based on an indication of the monitoring module.

The heat exchanger unit of the method may include a vertical axis; a frame comprising a top region, a bottom region, and a plurality of side regions; a first cooler coupled with the frame proximate to a respective side region and generally parallel to the vertical axis; a second cooler coupled with the frame proximate to the top frame and generally perpendicular to the vertical axis; and an inner airflow region within the heat exchanger unit. There may be a first baffle disposed within the inner airflow region, and at a first angle to the vertical axis.

The monitoring module may include a cover panel configured for direct or indirect coupling to the heat exchanger unit; an at least one sensor coupled with the cover panel, the at least one sensor having a respective rotating member with a plurality of blades extending therefrom; a logic circuit in operable communication with the at least one sensor; and a microcontroller. The microcontroller may have computer instructions for performing one or more of a plurality of tasks that includes: acquiring a set of data from the at least one sensor; sampling the set of data over a predetermined period of time, and computing an average and a standard deviation; comparing the standard deviation with predetermined data stored on a data storage; determining whether the set of data is acceptable within a defined parameter; determining whether a first lookup table comprising a set of lookup data has been completed, and creating the first lookup table using an averaging method if it has not; comparing the set of data to the set of lookup data; and providing the indication based on a result of the comparing the set of data to the set of lookup data step.

The indication from the monitoring module may be communicated to an end user by way of at least one of: a text message, an email, an audio signal, display, a visual indicator, and combinations thereof.

The monitoring module may further include one or all of: a solid data storage, a Wi-Fi module, a GSM module, and a CAN-Bus module being disposed within the controller housing and in operable communication with the microcontroller. The microcontroller may thus have computer instructions for communicating with one or more of the solid data storage, the Wi-Fi module, the GSM module, and the CAN-Bus module.

The heat exchanger unit of the method may include a third cooler; and a fourth cooler.

Any coolers of the heat exchanger unit may have a respective core and a respective tank. The respective core(s) may have a core end having a core end mass. The respective tank(s) may have a tank end having a tank end mass. In aspects, any respective core end mass may be greater than any respective tank end mass.

The heat exchanger unit of the method may include a mount assembly for coupling any cooler to the frame. The mount assembly may include an elongated fastening member; a rigid outer ring; a rigid inner ring; and a deformable ring disposed between the rigid outer ring and the inner outer ring. Any of the coolers of the heat exchanger unit may have a mounting slot, whereby the respective elongated fastening member may extend therethrough and at least partially into the frame.

The heat exchanger unit may have a second airflow region partitioned from the inner airflow region. The second airflow region may be associated with the third cooler and the fourth cooler. There may be a second baffle disposed within the second airflow region, and at a second angle to the vertical axis.

Other embodiments of the disclosure pertain to a heat exchanger unit that may have a vertical axis; a frame comprising a top region, a bottom region, and a plurality of side regions; a first cooler coupled with the frame proximate to a respective side region and generally parallel to the vertical axis; a second cooler coupled with the frame proximate to the top region and generally perpendicular to the vertical axis; a first fan mounted to the frame external to a first side of the first cooler; an inner airflow region within the heat exchanger unit; and a first baffle disposed within the inner airflow region, and at a first angle to the vertical axis.

The heat exchanger unit may include a third cooler coupled with the frame proximate to the respective side region, and adjacent the first cooler. The heat exchanger unit may include a fourth cooler coupled with the frame proximate to the top frame, and adjacent the second cooler.

The heat exchanger unit may include a second airflow region partitioned from the inner airflow region. The second airflow region may be associated with the third cooler and the fourth cooler.

The heat exchanger unit may have a second baffle disposed therein.

Any baffle of the heat exchanger unit may have or otherwise include a sound absorbing material. The sound absorbing material may be that for which is capable of reducing noise associated with a point source, such as noise from a fan. The sound absorbing material may be mineral wool.

The heat exchanger unit may include a second fan mounted to the frame external to a first side of the second cooler. Any fan of the heat exchanger unit may have an axis of rotation substantially perpendicular to the vertical axis.

The heat exchanger unit may include a monitoring module operably associated therewith. In aspects, the monitoring module may be proximately coupled to one of the first cooler, the second cooler, the third cooler, and the fourth cooler. The monitoring module may include: a cover panel; an at least one sensor coupled with the cover panel; at least one controller housing coupled with the cover panel; and a microcontroller disposed within the controller housing and in operable communication with the at least one sensor.

The sensor of the module may include a rotating member configured to generate a system signal proportional to an amount of rotation of the rotating member. The microcontroller may have computer instructions for processing the system signal.

The monitoring module may include a plurality of sensors, with each of the plurality of sensors in operable communication with the microcontroller. At least one of the plurality of sensors comprises may include a plurality of blades radially extending from the respective rotating member The monitoring module may include any or all of: a solid data storage, a Wi-Fi module, a GSM module, and a CAN-Bus module being disposed within the controller housing and in operable communication with the microcontroller. The microcontroller may be provided with computer instructions for communicating with one or more of the solid data storage, the Wi-Fi module, the GSM module, and the CAN-Bus module.

In aspects, the system signal may pertain to an amount of fouling.

In aspects, the heat exchanger unit may have a plurality of monitoring modules operably associated therewith.

Any cooler of the heat exchanger unit may have a respective core and a respective tank, which may further have a respective core end having a core end mass, and a respective tank end having a tank end mass. Although not necessary, the respective core end mass may be greater than the respective tank end mass.

Yet other embodiments pertain to a monitored heat exchanger system that may include a heat exchanger unit in operable engagement with a heat generating device, with an at least one service fluid being transferable therebetween. The HX unit may include a frame; and at least one cooler coupled with the frame, the at least one cooler having an airflow-in side and a service fluid-in side.

The system may include a monitoring module coupled to the heat exchanger unit. The monitoring module may include a panel (or cover panel); an at least one sensor coupled with the cover panel; an at least one controller housing coupled with the cover panel; and a microcontroller disposed within the controller housing and in operable communication with the at least one sensor.

The at least one sensor may include a rotating member configured to generate a system signal proportional to an amount of rotation of the rotating member. In aspects, the microcontroller may be provided with computer instructions, and may be otherwise operable, for processing the system signal.

The monitoring module may include a plurality of sensors. One or more of the plurality of sensors may be in operable communication with the microcontroller. In aspects, at least one of the plurality of sensors or the microcontroller may be powered at least partially, directly or indirectly, by rotation of the rotating member.

The at least one sensor may include a plurality of blades extending (such as generally radially) from the rotating member. The system signal may pertain to or be based on an amount of fouling associated with the airflow side of the at least one cooler.

The monitoring module may include one or more of a solid data storage, a Wi-Fi module, a GSM module, and a CAN-Bus module. Each may be disposed within the controller housing and may be in operable communication with the microcontroller. Accordingly, the microcontroller may be provided with computer instructions for communicating with one or more of the solid data storage, the Wi-Fi module, the GSM module, and the CAN-Bus module.

The at least one service fluid comprises one of lube oil, hydraulic fluid, fuel, charge air, transmission fluid, jacket water, and engine cooler. The heat generation device may be a diesel engine. In aspects, the heat exchanger unit may have four respective sides (and thus cubical or rectangular prism shaped). Each side may have a respective cooler mounted to the frame.

The heat exchanger unit may have a plurality of coolers configured to permit airflow to pass therethrough. In aspects, operation of a fan may result in airflow through each of the plurality of coolers, into the airflow region, and out of the outlet. The frame of the heat exchanger unit may include a plurality of horizontal members and vertical member configured together in a manner that results in a generally cube-shaped frame.

The heat exchanger unit of the system may include other configurations, such as a frame comprising a top region, a bottom region, and plurality of side regions; a plurality of coolers, each of the plurality of coolers coupled with the frame proximate to a respective side region, and each of the plurality of coolers comprising a core welded with a tank. Each core further may include a core end having a core end mass. Each tank further may include a tank end having a tank end mass. In aspects, each core end mass may be greater than each respective tank end mass.

The system may include the use of a mount assembly for coupling a cooler to the frame of the HX unit. The mount assembly may include an elongated fastening member; a rigid outer ring; a rigid inner ring; and a deformable ring disposed between the rigid outer ring and the inner outer ring.

Other embodiments of the disclosure pertain to a system that may include a heat exchanger unit in operable engagement (including fluid communication) with a heat generating device. There may be an at least one service fluid transferable therebetween. The heat exchanger unit may include a frame; and at least one cooler coupled with the frame, the at least one cooler having an airflow side and a service fluid side fluidly separated from each other.

The at least one service fluid may be one of lube oil, hydraulic fluid, fuel, charge air, transmission fluid, jacket water, and engine cooler. The heat generation device may be a diesel engine. The heat exchanger unit may have a plurality of sides, such as about three sides to about five sides. In aspects, there may be four sides. Any of the sides may have a respective cooler mounted to the frame proximate thereto. Any of the sides may have a respective monitoring module operably associated therewith.

In aspects, one or more cores may have a core end having a core end mass. In aspects, one or more tanks may have a tank end having a tank end mass. In aspects, the core end mass may be greater than the tank end mass of a respective core.

The heat exchanger unit may include a mount assembly associated therewith. The mount assembly may be configured for coupling a respective cooler to the frame. The mount assembly may include an elongated fastening member; a rigid outer ring; a rigid inner ring; and a deformable ring disposed between the rigid outer ring and the inner outer ring. The respective cooler may include at least one mounting slot, whereby the elongated fastening member may extend through the rigid inner ring and at least partially into the frame.

The heat exchanger unit may include a vertical axis; an airflow region within the heat exchanger unit; and a first set of baffles, each of the first set of baffles configured at an angle to the vertical axis.

Any of the baffles may have a sound absorbing material, such as mineral well, disposed therein (or therewith). An orientation angle of the baffle within the heat exchanger unit may be in the range of about 30 to about 60 degrees.

Any respective cooler may include a weld between the tank end and the core end that may be a v-groove weld.

The heat exchanger unit may include between about one set of baffles to about four sets of baffles, any of which may include the sound absorbing material, which may include mineral wool. Baffles of the sets may have various orientation angles, including in the range of about 30 degrees to about 60 degrees. Baffles of the sets may have various shapes, any of which may be generally isosceles trapezoidal in shape.

Embodiments of the disclosure pertain to a monitoring module for monitoring operation of a heat exchanger unit that may include a cover panel configured for direct or indirect coupling to the heat exchanger unit; one or more sensors coupled with the cover panel. Any of the one or more sensors may have a respective rotating member with a plurality of blades extending therefrom.

The module may include a logic circuit in operable communication with the plurality of sensors, and further comprising: a microcontroller and a data storage. The microcontroller may be configured with computer instructions for performing one or more of the tasks of: acquiring a set of data from at least one of the plurality of sensors; sampling the set of data over a predetermined period of time; computing an average and a standard deviation of the set of data; comparing the standard deviation with predetermined data; determining whether the set of data is acceptable within a defined parameter; determining whether a first lookup table comprising a set of lookup data has been completed, and creating the first lookup table using an averaging method if it has not; comparing the set of data to the set of lookup data; and providing an indication based on a result of the comparing the set of data to the set of lookup data step.

The microcontroller may be powered at least partially, directly or indirectly, by at least one of the plurality of sensors.

The indication may be communicated to an end user by way of at least one of: a text message, an email, an audio signal, a visual indicator, and combinations thereof.

The logic circuit may include the microcontroller in operable communication with one or more of: a Wi-Fi module, a GSM module, and a CAN-Bus module. Accordingly, the microcontroller may be provided with computer instructions for communicating with one or more of: the Wi-Fi module, the GSM module, and the CAN-Bus module.

Other embodiments of the disclosure pertain to a monitoring module that may include a cover panel mountingly associated with an airflow side of the heat exchanger unit; a plurality of sensors coupled with the cover panel, each of the sensors having a respective rotating member with a plurality of blades extending therefrom; a logic circuit in operable communication with the plurality of sensors. The logic circuit may include a microcontroller configured with computer instructions for performing one or more of the tasks of: acquiring a set of data from at least one of the plurality of sensors; sampling the set of data over a predetermined period of time of less than 120 seconds; computing an average and a standard deviation of the set of data; comparing the standard deviation with predetermined data stored in a data storage; determining whether the set of data is acceptable within a defined parameter; determining whether a first lookup table comprising a set of lookup data has been completed, and creating the first lookup table using an averaging method if it has not; comparing the set of data to the set of lookup data; and providing an indication based on a result of the comparing the set of data to the set of lookup data step.

The logic circuit may include the microcontroller in operable communication with one or more of a Wi-Fi module, a GSM module, and a CAN-Bus module. Thus the microcontroller may have computer instructions programmed therein for communicating with one or more of the Wi-Fi module, the GSM module, and the CAN-Bus module.

The monitoring module may be operable to provide the indication as it pertains to an amount of fouling on the airflow side.

The microcontroller may be powered at least partially by at least one of the plurality of sensors.

The heat exchanger unit may include a fan. The fan may be operable in a manner whereby the fan produces a point source dominant acoustic frequency. Which is to say during operation the fan may generate the point source dominant acoustic frequency. The sound absorbing material within respective baffles of the heat exchanger unit may be suitable to reduce the point source dominant acoustic frequency by at least 10 dB.

One or more baffles of the heat exchanger unit may be generally isosceles trapezoidal in shape. In aspects, each of the first set of baffles are generally isosceles trapezoidal in shape.

The sound absorbing material may be mineral wool.

One or more coolers of the heat exchanger unit may be configured to permit airflow to pass therethrough. Operation of the fan may result in airflow through at least one of the plurality of coolers, into the airflow region, and out of the outlet.

The frame may include a plurality of horizontal members and vertical member configured together in a manner that results in a generally 'cube-shaped' frame.

Other embodiments of the disclosure pertain to a heat exchanger unit that may include a vertical axis and a frame. The frame may include one or more regions, such as a top region, a bottom region, and a plurality of side regions.

The unit may further include a plurality of coolers. At least one of the plurality of coolers may be coupled with the frame proximate to a respective side region. At least one of the plurality of coolers may have an outer surface and an inner surface.

The heat exchanger unit may have an airflow region therein.

The fan may be operable with an axis of rotation. The axis of rotation may be substantially parallel to the vertical axis. Operation of fan may result in airflow through one or more of the plurality of coolers, into the airflow region, and out of the top region.

The exchanger unit may include other components or features, such as a tubular fan mount bar; a shroud coupled to a top surface; and an aeroring. There may be a fan mount coupled to the tubular fan mount bar. There may be a fan coupled to the fan mount. The fan may be a hydraulic motor.

Yet other embodiments of the disclosure pertain to a heat exchanger unit that may include a frame having one or more associated regions, such as a top region, a bottom region, and a plurality of side regions. The heat exchanger unit may have a plurality of coolers coupled with the frame. Various coolers of the plurality of coolers may be coupled with the frame proximate to a respective side region. The coolers may have an outer surface and an inner surface.

The heat exchanger unit may include one or more mount assemblies. A respective mount assembly (or sometimes 'flexible mount assembly') may be configured for the coupling of a corresponding cooler of the plurality of coolers to the frame.

The amount assembly may include an elongated fastening member; a rigid outer ring; a rigid inner ring; and a deformable ring disposed between the rigid outer ring and the inner outer ring.

In aspects, the mount assembly may include a top plate, a bottom plate, and a washer.

Any of the plurality of coolers may include a mounting slot. The elongated fastening member may extends through the rigid inner ring. The elongated fastening member may extend at least partially into and/or engage the frame.

The heat exchanger unit may include an axis, such as a vertical axis.

The heat exchanger unit may include an airflow region therein.

The heat exchanger unit may include a first set of baffles. One or more baffles of the first set of baffles may be configured (positioned, oriented, etc.) at a respective angle to the vertical axis.

The heat exchanger unit may include other sets of baffles, such as a second set of baffles, third set of baffles, fourth set of baffles, fifth set of baffles, etc. One or more baffles of the second set of baffles may be configured at a respective second angle to the vertical axis. One or more baffles of the third set of baffles may be configured at a respective third angle to the vertical axis. Other baffles of other sets may likewise be configured with a respective angle to an applicable axis.

Any of the sets of baffles may have between about one to about ten baffles. In aspects, the first set of baffles, the second set of baffles, and the third set of baffles may each have about three to about five baffles.

Any of the baffles of the heat exchanger unit may have therewith or otherwise be configured with a sound absorbing material. In aspects, any of the baffles of either of the first set of baffles, the second set of baffles, and the third set of baffles may include the sound absorbing material. The sound absorbing material may be mineral wool.

Any of the baffles of the heat exchanger unit may formed with a desired shape. For example, one or more of the baffles of the first set of baffles may have a generally isosceles trapezoidal shape.

Any of the baffles of the heat exchanger unit may be configured with a respective angle to an axis. The angle may be in the range of about 30 degrees to about 60 degrees.

Any of the plurality of coolers may be configured to permit airflow to pass therethrough. In aspects, operation of a fan of the heat exchanger unit may result in airflow through any of the respective plurality of coolers, into the airflow region, and out of an exhaust outlet.

The heat exchanger unit may include one or more mount assemblies. A respective mount assembly may be configured for the coupling of, at least partially, a corresponding cooler of the plurality of coolers to the frame. Any respective mount assembly may include various components, such as an elongated fastening member; a rigid outer ring; a rigid inner ring; a deformable ring disposed between the rigid outer ring and the inner outer ring.

Any cooler may include or be associate with one or more mounting slots. The elongated fastening member of a respective mount assembly may be configured to extend into and through the rigid inner ring, through the respective mounting slot, and/or at least partially into the frame.

Any mount assembly may include a top plate, a bottom plate, and/or a washer.

The frame of the heat exchanger unit may include one or more frame members, such as horizontal members and vertical members. In aspects, a plurality of horizontal members and vertical member coupled together in a manner that results in a desired frame shape. The desired frame shape may be a cube-shape.

Other embodiments of the disclosure pertain to a method of operating or otherwise using a heat exchanger unit of the present disclosure. The method may include the steps of assembling a heat exchanger unit that includes a plurality of horizontal members and vertical member coupled together in a manner that results in a desired frame shape. The heat exchanger unit may include one or more coolers. One or more coolers may be associated with one or more respective mount assemblies. The mount assemblies may be configured or otherwise suitable for the coupling, at least partially, of the respective cooler to the frame.

The method may include the step of associating a fan (or fan system) with the frame. The fan may be driving by a motor, which may be a hydraulic motor.

The method may include the step of operating the fan motor with a pressurized hydraulic fluid.

The method may include using one or more coolers having a respective core end welded with a first tank end. The core end may have a core end mass. The first tank end may have a tank end mass. The core end mass may be greater than the tank end mass.

The heat exchanger unit may include various sets of baffles, such as a first set, second set, third set, fourth set, etc.

Any baffle of any respective set of baffles may be coupled to the frame. Any baffle of any respective set of baffles may have a material capable of effecting sound associated therewith.

In aspects, any baffle of the first set of baffles may be coupled to the frame at an orientation of a respective first angle to the axis. Any baffle of the first set of baffles may include a sound absorbing material.

In aspects, any baffle of the second set of baffles may be coupled to the frame at an orientation of a respective second angle to the axis. Any baffle of the second set of baffles may include a sound absorbing material.

In aspects, any baffle of the third set of baffles may be coupled to the frame at an orientation of a respective third angle to the axis. Any baffle of the third set of baffles may include a sound absorbing material.

In aspects, any baffle of the fourth set of baffles may be coupled to the frame at an orientation of a respective fourth angle to the axis. Any baffle of the fourth set of baffles may include a sound absorbing material.

Any of the respective first angle, the second angle, the third angle, and the fourth angle may be in the range of about 30 to about 60 degrees.

Any respective set of baffles may be positioned a quarter wavelength below the fan, the quarter wavelength being calculated based on a dominant acoustic frequency generated by the fan during its operation.

The method may include the step of using at least one baffle within the heat exchanger unit that has a sound absorbing material therein.

The method may include the step of coupling the heat exchanger unit with a heat generating device. The heat exchanger unit and the heat generating device may be in fluid communication.

Other embodiments of the disclosure pertain to a system for cooling a fluid that may include a heat exchanger unit of the present disclosure coupled in fluid communication with at least one heat generating device. The heat exchanger unit may include a plurality of horizontal members and vertical member coupled together in a manner that results in a desired frame shape. The heat exchanger unit may include one or more coolers. One or more coolers may be associated with one or more respective mount assemblies. The mount assemblies may be configured or otherwise suitable for the coupling, at least partially, of the respective cooler to the frame.

The heat exchanger unit of the system may include a fan coupled with the frame. The fan may be operably associated with a motor, which may be a hydraulic motor. The motor may be operable via the use of a pressurized hydraulic fluid.

The heat exchanger unit of the system may include one or more coolers having a respective core end welded with a first tank end. The core end may have a core end mass. The first tank end may have a tank end mass. The core end mass may be greater than the tank end mass.

The heat exchanger unit of the system may include various sets of baffles, such as a first set, second set, third set, fourth set, etc.

Any baffle of any respective set of baffles may be coupled to the frame. Any baffle of any respective set of baffles may have a material capable of effecting sound associated therewith.

The heat exchanger unit and the heat generating device may be in fluid communication.

There may be a plurality of heat exchanger units coupled with a respective plurality of heat generating devices.

In aspects, the heat generating device may be an engine of a frac pump. The frac pump may be associated with a mobile frac pump skid or trailer. In aspects, the heat generating device may be an engine of a blender unit. The engine may be associated with a screw auger or blender unit booster pump.

The system may include the frac pump in fluid communication with a wellbore. The system may include the booster pump in fluid communication with the frac pump. The system may include the blender unit in fluid communication with the frac pump skid.

Figure 2A:
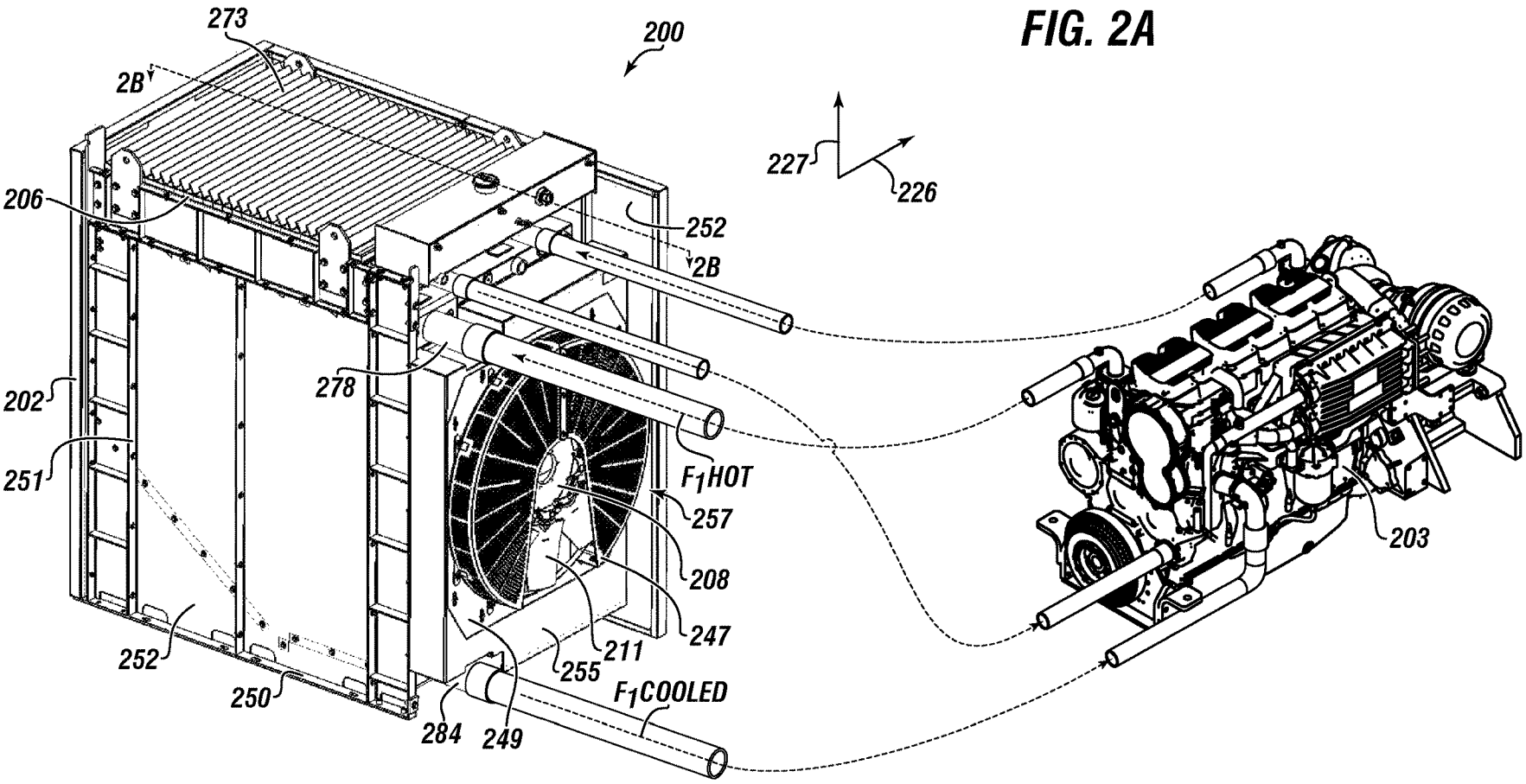
FIG. 2A shows an isometric view of a heat exchanger unit with a top mounted cooler coupled in fluid communication with a heat generation device according to embodiments of the disclosure.
Figure 2B:
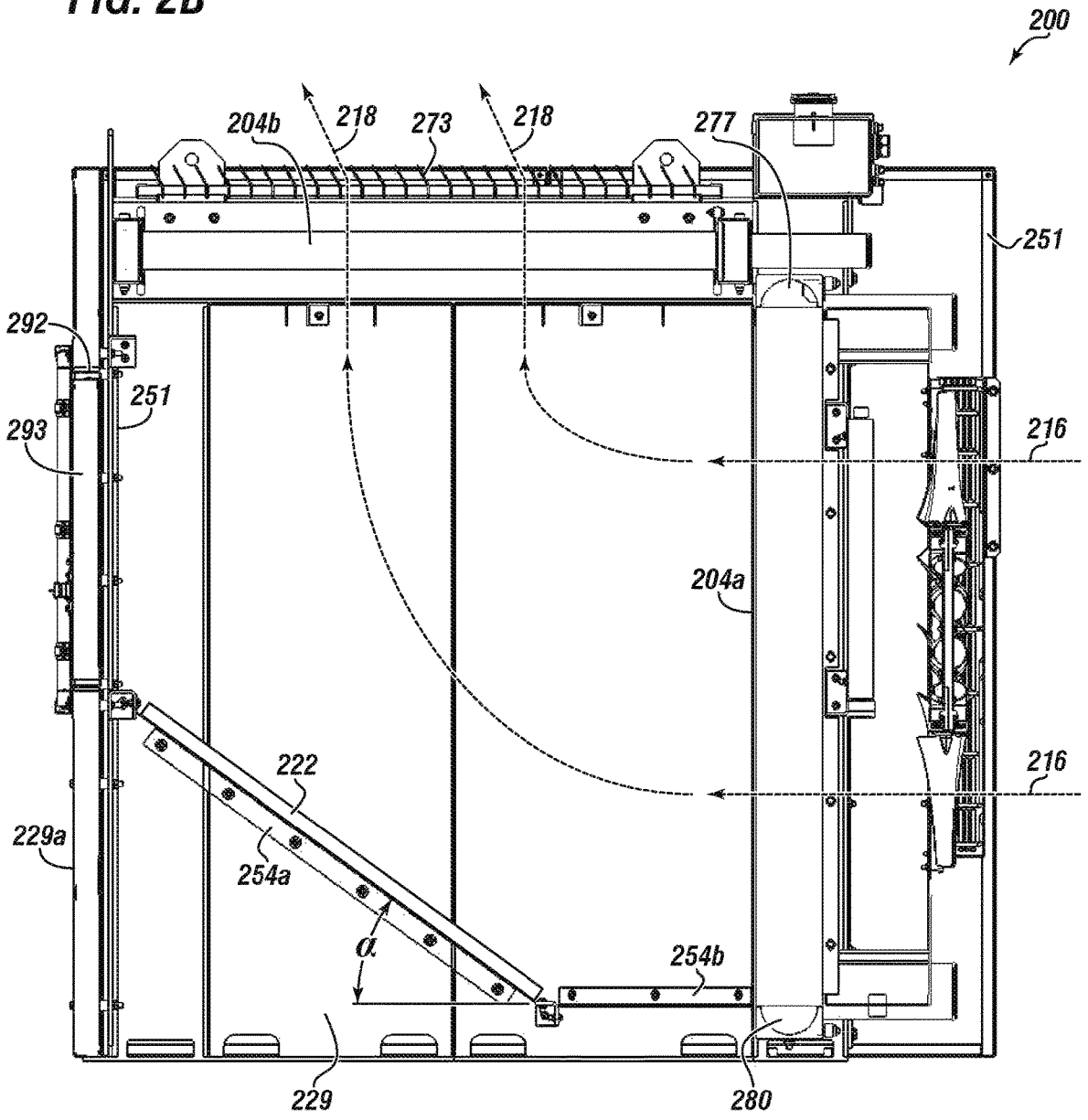
FIG. 2B shows a lateral cutaway view of the heat exchanger unit of FIG. 10A according to embodiments of the disclosure.

Referring now to FIGS. 2A and 2B together, an isometric view of a heat exchanger unit with a top mounted cooler, and coupled in fluid communication with a heat generation device, and a lateral cutaway view of the heat exchanger unit, respectively, in accordance with embodiments disclosed herein, are shown.

Embodiments herein apply to a heat exchanger unit that may be an inclusive assembly of a number of components and subcomponents. The heat exchanger unit 200 may be like that in many respects to any heat exchanger unit described and disclosed in any of co-pending, co-owned U.S. non-provisional application Ser. Nos. 15/591,076, 15/477,097, and 15/477,097 (or also, the Applications). For the sake of brevity of the present disclosure, each application is incorporated herein by reference for all purposes.

FIGS. 2A and 2B illustrate a variant cube-shape heat exchanger unit. As would be appreciated, the heat exchanger unit 200 need not be the same as previously disclosed, and indeed as shown ahere may have a number of discernable differences. The heat exchanger unit 200 may include a solid integral frame (or skeletal frame) or may be a frame 202 that includes a number of elements arranged and coupled together, such as a plurality of horizontal elements 250 and a plurality of vertical elements 251.

Although the shape of the frame 202 need not be limited, FIGS. 2A and 2B together illustrates a generally rectangular prism shape (i.e., four side regions, a top region, and a bottom region) that results from the horizontal elements 250 and the vertical elements 251 being connected at various corners and/or generally perpendicular to one another, and joined together with various sheeting (or sidewall) 252.

Other shapes of the frame 202 could include cylindrical, hexagonal, pyramidal, and so forth. As the shape of the frame 202 may vary, so may the shape of frame elements 250, 251.

The frame 202 may include additional frame support plates (including interior and exterior), sidewalls, sheeting, etc., which may be suitable for further coupling frame elements together, as well as providing additional surface area or contact points for which other components may be coupled therewith. In aspects, one or more frame support plates 254*a* may have an angled inclination orientation (such as greater than 0 degrees to less than 90 degrees from either axis 226, 227), whereas one or more frame support plates 254*b* may have a generally horizontal orientation. One or more frame support plates (e.g., 254*a*) may include a support plate slot or groove, which may be useable for mounting the plate to the frame 202.

Members (or frame 202) 250, 251 include one or more core support mount slots, whereby a radiator core (or 'core') 206 may be coupled therewith. There may be a plurality of such slots configured and arranged in a manner whereby a plurality of cores 206 may be coupled therewith. One or more coolers (comprising a respective core 206) may be coupled to the frame with respective mount assemblies (e.g., see Applications, FIGS. 5A-5E). There may be a first cooler 204*a* and a second cooler 204*b*.

One or more cores 206 may be associated with and proximate to a respective protective grate (not shown here), which may be useful for protecting fins 273 of the core 206.

The frame 202 may include yet other additional support or structural elements, such as one or more frame support bars, which may be coupled between various elements 250, 251, such as in a horizontal, vertical, or diagonal manner. The support bar(s) may be coupled to elements in a known manner, such as rivet, weld, nut-and-bolt, etc.

The frame 202 may also include a plate 255, which may have a plate opening. The plate opening may be of a shape and size suitable for accommodating airflow therethrough. The HX unit 200 may include a fan system 257. The fan system 257 may include related subcomponents, such as a fan 208 that may be understood to include a rotating member with a plurality of fan blades 211 extending therefrom. The fan system 257 may be operable by way of a suitable driver, such as a fan motor, which may be hydraulic, electrical, gas-powered, etc. The fan motor may receive power through various power cords, conduits, etc., as would be apparatent to one of skill in the art. The fan 208 may operate in the range of about 200 rpm to about 1200 rpm, and may further operate in a manner to provide airflow in the range of about 10,000 cfm to about 200,000 cfm. The originating noise of the fan 208 may be the range of about 70 dB's to about 120 dB's. The frequency of noise from the fan 208 may be in the range of about 20 hz to about 20,000 hz.

The frame 202 may include a fan rock guard mount, which may be used for the coupling of a fan rock guard 247 thereto. The frame 202 may include a fan mount plate 249. The fan system 247 can be operable to draw (or blow) in and direct the flow of air 216. The air 216 may be drawn (or blown) through the sides of the HX unit 200 (and respective cores, which may then be used to cool one or more utility fluids F) and out as heated exhaust 218. The benefit of such a configuration is the ability to provide cooling while saving space and/or reducing noise. Utility fluid F (or multiple F's) may include by way of example, lube oil, jacket water, turbo (such as for an engine), transmission fluid (such as for a pump), and hydraulic fluid.

One of skill in the art would appreciate that airflow through the cooler 204*a* may be generally in a path parallel to horizontal axis 226. In an analogous manner, the fan 208 may have an axis of rotation generally parallel to horizontal axis 226. In aspects, airflow through the first cooler 204*a* may be generally parallel to the fan 208 axis of rotation. In aspects, airflow through the second cooler 204*b* may be generally perpendicular to the fan 208 axis of rotation. Accordingly, airflow through the HX unit 200 may be transitioned from (approximately) horizontal to vertical as the airflow moves through the unit 200 and out as heated exhaust 218.

As such, by way of example, utility fluid Fi may be transferred from a heat generating device 203 at a hot temperature into an HX unit inlet 278, cooled with airflow cooler 204*a*, and transferred out of an HX unit outlet 284 back to the HGD 203 at a cooler temperature. While not meant to be limited, HGD 203 may be an engine (including diesel engine), a genset, a motor, a pump, or other comparable equipment that operates in a manner whereby a utility fluid is heated.

There may be one or more cores 206. A respective 'cooler' or 'cooling circuit' may include one or more cores 206. The HX unit 200 may have between about 1 to about 8 cooling circuits, which each may be configured for cooling in parallel to each other.

Any cooler 204 *a,b* (or respective core) of the disclosure may be mounted to the frame 202 with a flexible mount assembly as described in Applications, FIGS. 5A-5F and supporting text. Although not shown here, the flexible mount assembly may be coupled to the frame 202 (or also vertical member 251 and/or horizontal member 250) via a nut plate or threaded receptacle.

Airflow through an HX unit 200 may be turbulent and otherwise chaotic. In addition, a fan 208 may be so loud in noise emission that it may be impossible to have a conversation between operators in an area of proximity near the fan 208 (or HX unit 200). In addition or the alternative, the noise from the fan 208 may exceed a regulation, which is of even greater significance in the event the HX unit 200 is used in or proximate to a residential setting.

As shown, the HX unit 200 may be configured with one or more baffles 222, which may be arranged or otherwise installed on a pseudo-interior side 229 of the unit 200 (the "exterior" 229*a* and "interior" 229 of the HX unit 200 may be thought of as positionally relative to where ambient air and heated air are). Ingress and egress may be provided via access way 292. The access way may be closed via door 293, which may be, for example, hingedly mounted to the frame. The door 293 may be shut and held shut via one or more securing members (not viewable here).

Although numerous components around or proximate to the HGD 203 may be a source of noise, the fan 208 may produce a noise having dominant acoustic frequency 'f' with initial amplitude. To reduce noise emitted from the fan 208, the HX unit 200 may be configured with one or more baffles 222 coupled to the frame 202 (such via frame member 254*a*). In aspects, airflow through HX unit 200 may actually increase as a result of the presence of baffle 222. This synergistic effect is believed attributable to the baffle 222 (and position of the baffles) helping to streamline the airflow, rather than acting as a restriction. The baffle 222 may be like that described in Applications (see, e.g., FIGS. 3A-3B and related text).

Thus, instead of chaotic turbulence within the interior of the HX unit 200, a baffle shape and an angled orientation of the baffles 222 may result in smoothing out the transition of the airflow from generally horizontal to generally vertical, reducing the airflow recirculation within the interior of HX unit 200, and thus reducing restriction and increasing airflow. The angled orientation may allow for a wider baffle width, which when paired with the proper baffle spacing and absorption material, may work to reduce undesirous fan noise.

While the baffle 222 may be shown herein as having a generally planar face, it will be understood that baffle 222 may have other shapes, such as curved (thus a non-planar face). The positioning of any baffle 222 herein may depend on an angle at which the respective baffle 222 is mounted, and will generally be at an angle α between 0 and 90 degree relative to the vertical axis (i.e., an angle defined by where the plane of the baffle face intersects an axis). In aspects, the angle α may be in the range of about 30 degrees to about 60 degrees. Dimensions of the baffle 222 herein may be dependent upon variables, such as the size of the HX unit 200, proximity of other baffles, and the angle α of the baffle orientation, and may change from those depicted. The angle α of baffle orientation may help direct airflow into and toward an exhaust outlet, such that air may be more easily drawn through the HX unit 200.

The baffle(s) 222 may be designed, configured, and oriented (positioned) to optimize a reduction in amplitude of fan noise. One or more baffles 222 may be made to include or be fitted with a sound absorbing material (262, FIG. 2C). The material may be mineral wool or another suitable material as described herein.

The baffle 222 may be non-isosceles trapezoidal in shape, may also be configured in a manner to accommodate various equipment piping, ducts, etc. While baffle shape is not meant to be limited, the baffle shape may be generally rectangular in nature.

There may be additional baffles 222, such as a second baffle, a third baffle, and so forth. The use of the second baffle may result in a second airflow region proximate thereto.

While the number of baffles 222 (including sets of baffles) is not meant to be limited, there may be spatial and operational constraints and considerations. For example, too many baffles may result in inability for adequate airflow, and too few baffles may have no effect on negating unwanted noise.

At the same time, the sound absorbing material (see also FIG. 2C) within the baffle(s) may provide the synergistic effect of reducing decibels of the noise attributable to operation of the fan 208. A person standing next to a fan and radiator may not be able to have an audible conversation with another person standing relatively adjacent thereto, as the loudness may be in excess of 70 dBs. In contrast, beneficially the operation of the HX unit 200 configured with the baffle 222 in accordance with embodiments of the disclosure results in significantly reduced noise whereby person-to-person conversation in the proximate vicinity of the HX unit 200 may be possible. The reduced loudness may be in the range of about to 20 dB's to about 65 dB's.

Figure 2C:
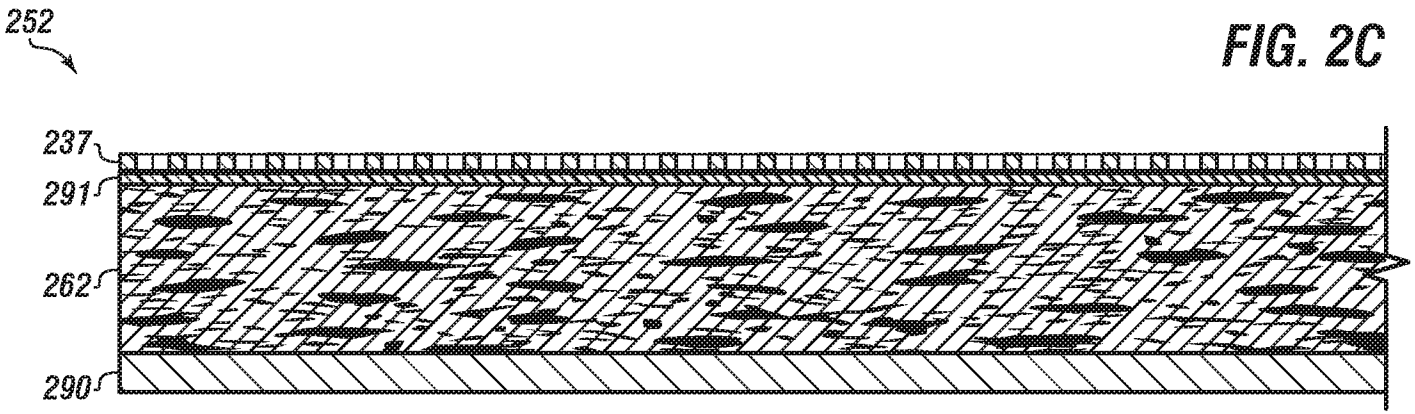
FIG. 2C shows a breakout view of a sidewall according to embodiments of the disclosure.

Referring briefly to FIG. 2C, a breakout cross-sectional view of a sidewall of a heat exchanger unit, in accordance with embodiments disclosed herein, is shown. The HX unit 200 may include one or more sidewalls 252 configured with various layers. For example, the outer exterior side may be a sheeting layer 290, which may be sheet metal. The interior side of the sidewall 252 (i.e., the side exposed inward in interior 229, FIG. 2B) may have a mesh 237. Between the mesh 237 and sheeting layer 290 may be one or more layers of additional material.

As shown, there may be a layer of sound absorbing material 262. The sound absorbing material may be mineral wool or other comparable material. There may be a layer of material 291. In aspects, the sound absorbing material 262 may be positioned between the sheeting layer 290 and the layer of material 291. The layer of material may be a vinyl-based material. In aspects, the layer of material 291 has physical properties and characteristics of being able to reduce or otherwise mitigate the passing of sound thereby.

Referring again to FIGS. 2A-2B, the coolers 204 *a,b* may be coupled to the frame 204 in accordance with embodiments disclosed herein, including directly, or indirectly via mounting to the frame 202. The coolers 204 *a,b* may include at least one core and a tank. The core(s) 206 may include one or more tanks (such as inlet tank 277 and outlet tank 280) welded thereto. The inlet tank 277 may be associated with the tank inlet 278. Similarly, the outlet tank 280 may be associated with a tank outlet 284.

One of ordinary skill in the art would appreciate that embodiments herein provide for an improved heat exchanger unit of the present disclosure that need not have one or more baffles therein.

Figure 3A:
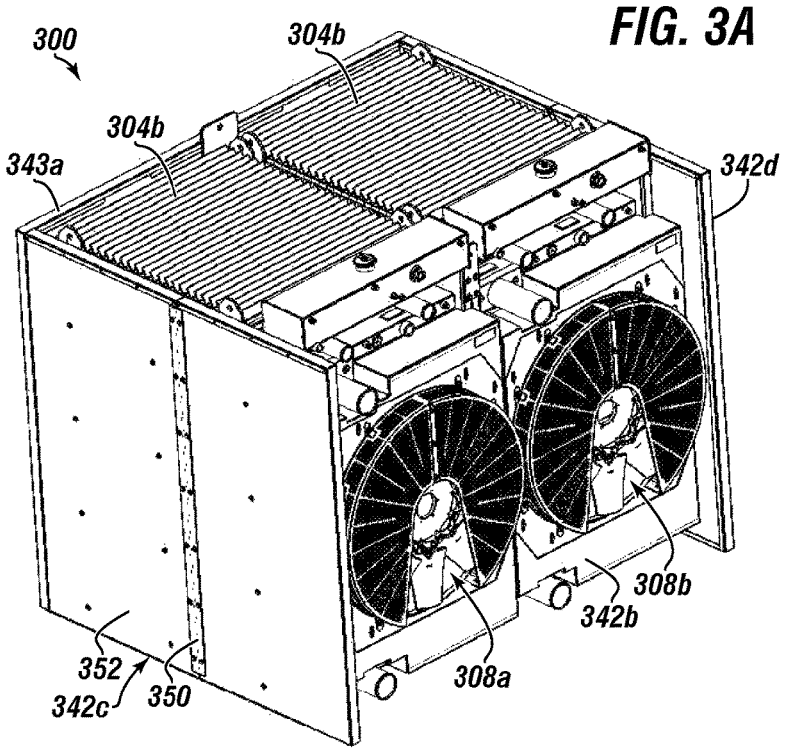
FIG. 3A shows a front isometric view of a heat exchanger unit with two top mounted coolers according to embodiments of the disclosure.
Figure 3B:
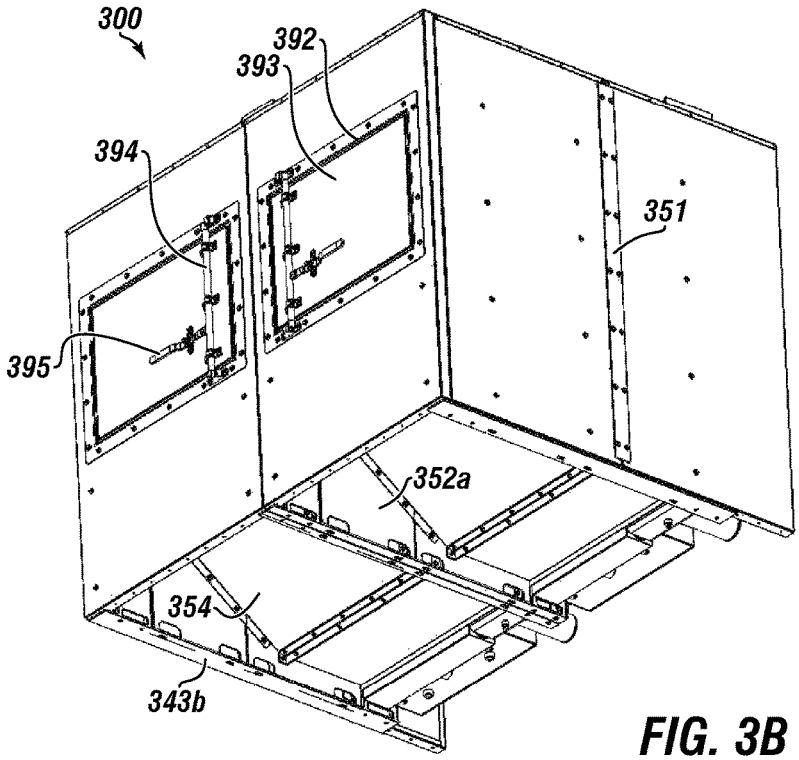
FIG. 3B shows a back isometric view of the heat exchanger unit of FIG. 11B according to embodiments of the disclosure.
Figure 3C:
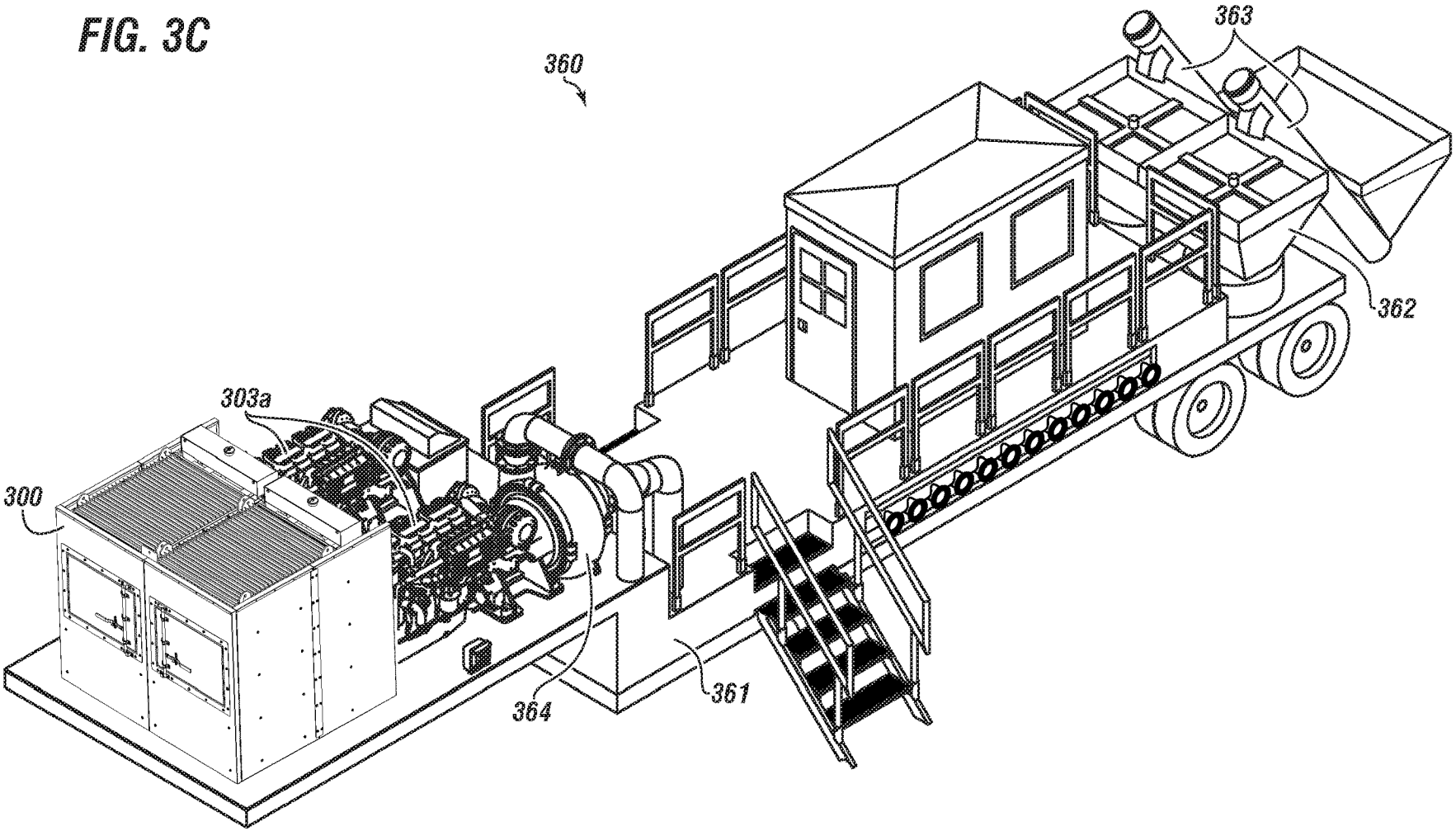
FIG. 3C shows a blender skid having the heat exchanger unit of FIGS. 11A-11B according to embodiments of the disclosure.

Referring now to FIGS. 3A, 3B, and 3C together, a frontal isometric view and a backside isometric view of a heat exchanger unit with two top side mounted coolers, and a blender skid having the heat exchanger unit of FIGS. 3A-3B coupled with two heat generating devices, respectively, according to embodiments of the disclosure, are shown.

The HX unit 300 may be like that in many respects to the heat exchanger unit 200 described herein, but as would be readily apparent need not be the same, and indeed may have a number of discernable differences. Unit 300 may be like that of a unit(s) described in the Applications, but for brevity not described in detail. The heat exchanger unit 300 may include a solid integral frame (or skeletal frame) or may be a frame 302 that includes a number of elements arranged and coupled together, such as a plurality of horizontal elements 350 and a plurality of vertical elements 351.

The frame may include a top region 343*a*, a bottom region 343*b*, and a plurality of side regions 342 *a-d*. There may be a first cooler (not viewable here) coupled with the frame 302 proximate to a respective side region 342*d*. The first cooler may have a respective long (or longitudinal axis) that may be generally parallel to a vertical axis 327.

The HX unit 300 may include a second cooler 304*b* coupled with the frame 302 proximate to the top region 343*a*. The second cooler 304*b* may have its long axis generally perpendicular to the vertical axis 327. Although not viewable here, there may be an inner airflow region within the heat exchanger unit 300. In this respect, there may be a first baffle (e.g., 222, FIG. 2B) disposed within the inner airflow region, and at a first angle α to the vertical axis 327.

The HX unit 300 may include a third cooler (not viewable here) coupled with the frame 302 proximate to the respective side region 342*d*, and adjacent the first cooler. And the HX unit 300 may have a fourth cooler 304*d* coupled with the frame 302 proximate to the top region 343*a*, and adjacent the second cooler 304*b*.

The HX unit may include an inner partition 352*a* that separates the first airflow region from a second airflow region associated with the third cooler and the fourth cooler. The partition 352*a* may be formed by connecting two sidewalls together.

The second airflow region may include a second baffle (e.g., 222, FIG. 2B), which may be configured or otherwise oriented at a second angle α to the vertical axis 327. In aspects, either or both of the first angle and the second angle may be in the range of about 0 degrees to 90 degrees. In aspects, either or both of the first angle and the second angle may be in the range of about 30 to about 60 degrees. Although they need not be, the first angle and the second angle may be substantially the same (i.e., equal or nearly equal to each other).

The first baffle 322 and/or the second baffle may include a sound absorbing material disposed therein (see, e.g., FIG. 2C). The HX unit 300 may include a first fan 308*a* and a second fan 308*b*. Either of the fans 308 *a,b* may be configured to operate and produce a point source dominant acoustic frequency. The sound absorbing material may be capable to reduce the point source dominant acoustic frequency by at least 10 dB.

The first fan 308*a* may be mounted to the frame 302 external to a first side of the first cooler. In a similar manner, the second fan 308*b* may be mounted to the frame external to a first side of the second cooler. The first fan 308*a* and the second fan 308*b* may each have an axis of rotation substantially perpendicular to the vertical axis 327.

In operation, the first cooler and/or the second cooler may be configured to permit airflow to pass therethrough. Related thereto, operation of the first fan 308*a* and/or the second fan 308*b* may result in airflow through each of the respective coolers and airflow regions, and out of the outlet.

The HX unit may include a first sidewall; a second sidewall; a back wall; and a bottom. In aspects, at least one of the first sidewall, the second sidewall, the back wall, and the bottom further may include: an inner layer of sound absorbing material; and an exterior layer of a vinyl-based material. Any of the sidewall(s) may be like that as shown and described for FIG. 2C.

The HX unit 300 may be configured and operable with a monitoring module 1000 as described herein and/or in the Applications. Ingress and egress may be provided via access way 392. The access way 392 may be closed via door 393, which may be, for example, hingedly mounted to the frame 302. The door 393 may be shut and held shut via one or more securing members 394. In aspects, turning handle 395 may move the securing member 394 to a position, whereby the door 393 may be opened, and the inside of the HX unit 300 may be accessed.

FIG. 3C illustrates the HX unit 300 may be used and operable with a blender unit 360 for creating a frac fluid mixture. One of skill in the art would appreciate the blender unit 360 may be a stationary process, or provided with mobility via a trailer 361. The blender unit 360 may include one or more blender tubs 362; one or more auger screws 363; and at least one HGD 303*a*. The HGD 303*a* may be a diesel engine.

The HX unit 300 may be configured to cool at least one service fluid transferable between the HX unit 300 and the first HGD 303*a*.

The second cooler 304*b* may be coupled with the frame 302 generally perpendicular to the orientation of the first cooler. In this respect, the second cooler 304*b* may be coupled with the frame 302 proximate to the top region 343*a*. In other aspects, the second cooler 304*b* may be coupled with the frame 302 generally parallel to the orientation of the first cooler. In this respect, the second cooler 304*b* may be coupled with the frame 302 proximate to another side region. The first cooler and/or the second cooler may be thought of has having a long (longitudinal) axis through itself, which may be used as a reference point with respect to other axis. The orientation reference is generally understood as being with respect to a long axis through the core.

The HX unit 300 may have a third cooler 304*c* coupled with the frame 302 proximate to the respective side region, and adjacent the first cooler 304*a*. The HX unit 300 may include a fourth cooler 304*d* coupled with the frame 302 proximate to the top region 343*a*, and adjacent the second cooler 304*b*.

The HX unit 300 may include a second airflow region partitioned from the inner airflow region. The second airflow region may be associated with the third cooler and the fourth cooler. There may be a second baffle disposed within the second airflow region, and at a second angle to the vertical axis. The second baffle may include a sound absorbing material. In aspects, the sound absorbing material may be mineral wool.

The angle of orientation of any baffle 322 of the HX unit 300 may be in the range of about 30 to about 60 degrees. In embodiments, the first angle and the second angle may be at least substantially the same.

The HX unit 300 may include a second fan 308*b* mounted to the frame 302 external to a first side of the third cooler. The first fan 308*a* and the second fan 308*b* each may each have an axis of rotation substantially perpendicular to the vertical axis 327.

Any of the coolers of the HX unit 300 may be configured to permit airflow to pass therethrough. Operation of the first fan 308*a* and the second fan 308*b* may result in airflow (drawn or blown) through each of the respective coolers and airflow regions, and out of the outlet.

The HX unit 300 may have at least one monitoring module 1000 of the present disclosure operably associated therewith (see also Applications)

Any of the first cooler, the second cooler, the third cooler, and the fourth cooler may have a respective core and a respective tank. The at least one of the respective cores may have a core end having a core end mass. The at least one of the respective tanks may have a tank end having a tank end mass. In aspects, the core end mass may be greater than the respective tank end mass, as provided for in embodiments herein (See, e.g., Applications, FIGS. 4A-4C).

The HX unit may include a mount assembly for couple any of the coolers to the frame. The mount assembly may be as described herein, and may thus include an elongated fastening member; a rigid outer ring; a rigid inner ring; and a deformable ring disposed between the rigid outer ring and the inner outer ring. At least one of the plurality of coolers may include a mounting slot, whereby the elongated fastening member may extend through the rigid inner ring and at least partially into the frame (See, e.g., Applications FIGS. 5A-5E).

One of skill in the art would appreciate the blender unit 360 may be operable with other HX unit embodiments of the disclosure.

Figure 3D:
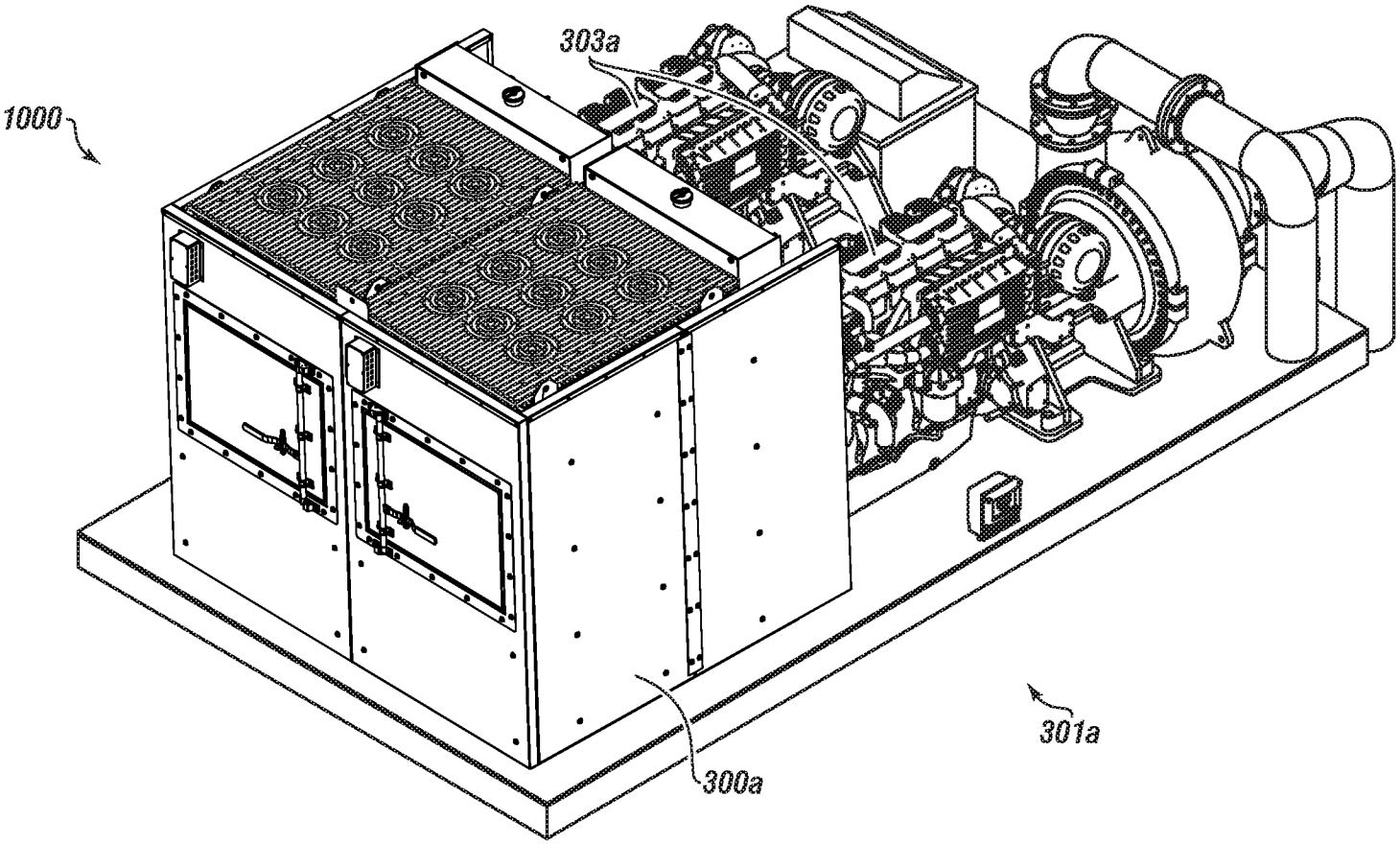
FIG. 3D shows a side view of a monitored heat exchanger system that includes a monitoring module, a heat exchanger unit with at least one topside mounted cooler, and a heat generating device coupled together according to embodiments of the disclosure.

Referring now to FIG. 3D, a side view of a monitored heat exchanger system that includes a monitoring module, a heat exchanger unit, and a heat generation device, operably coupled together, in accordance with embodiments disclosed herein, are shown. Embodiments herein apply to a heat exchanger unit that may be an inclusive assembly of a number of components and subcomponents. The heat exchanger unit 300*a* may be part of an overall system 301*a* that may be monitored. Monitored system 301*a* may include at least one monitoring module 1000, as described herein.

While it need not be exactly the same, system 301*a* may be like that of systems herein or as otherwise disclosed and described in the Applications, and components thereof may be duplicate or analogous. Thus, only a brief discussion of system 301*a* is provided, recognizing that differences, if any, should be discernable by one of skill in the art. Accordingly it would be further understood that aspects of system 301*a* may include various additional improvements related to airflow, noise reduction, cooling efficiency, structural integrity, and combinations thereof.

The HX unit 300*a* may include one or more coolers being associated with respective monitoring module(s) 1000. It should be apparent that while HX unit 300*a* may have a plurality of sides (or side regions), and one or more sides may have respective coolers, not every side (nor cooler) need have a monitoring module 1000. Still, it may very well be that every cooler is monitored via one or more modules 1000. Moreover, while the module 1000 may be particularly useful for monitoring fouling, other conditions of the HX unit 300*a* (or system 301*a*) may be monitored.

The fan system (e.g., 257, FIG. 2A) can be operable to draw (or blow) in and direct the flow of air. The air may be drawn through the sides of the HX unit 300*a* (and respective cores, which may then be used to cool one or more utility fluids F) and out as heated exhaust. Utility fluid F (or multiple F's) may include by way of example, lube oil, jacket water, turbo (such as for an engine), transmission fluid (such as for a pump), and hydraulic fluid (such as for the fan drive).

One of skill in the art would appreciate that airflow through the cooler(s) may be generally in a path parallel to a horizontal axis. In an analogous manner, the fan (e.g., 308, FIG. 3A) may have an axis of rotation generally perpendicular to a vertical axis. Accordingly, airflow through the HX unit 300*a* may be transitioned from (approximately) horizontal to vertical as the airflow moves through the coolers and out the fan exhaust.

While not meant to be limited, HGD 303*a* may be an engine, a genset, a motor, a pump, or other comparable equipment that operates in a manner whereby a utility fluid is heated.

There may be one or more cores. A 'cooler' or 'cooling circuit' may include one or more cores. The HX unit 300*a* may have between about 1 to about 8 cooling circuits, which each may be configured for cooling in parallel to each other.

The HX unit 300*a* may include various sound reduction or integrity features like that as described herein, such as various sound baffle configurations and/or flexible mount assemblies.

Embodiments herein provide for a system (and related method of operating or using the system) using on or more components described herein. For example, such a system may include a wellbore and other wellbore and production equipment, as well as a frac trailer and/or a blender skid. The frac trailer may include a frac pump, a HGD, and a HX unit as pertaining to the disclosure. The blender skid may include a booster pump, at least one HGD, and a HX unit as pertaining to the disclosure.

Other embodiments herein provide for a method of doing business related to a monitored heat exchanger system. The method may include the steps of having a customer relationship between a provider and recipient (i.e., customer, client, etc.). The method may include charging a one-time or ongoing fee related to the monitored system. The provider may install the monitored heat exchanger system as a new standalone skid. Alternatively, the provider may retrofit existing equipment for operable communication with a monitoring module as described herein. Thus, in embodiments there may be a first transaction related to equipment purchase or use, followed by a second transaction related to installation.

Another part of transaction, or alternatively, a separate transaction, may pertain to a license for the use software (or programming) related to a logic circuit of the monitoring module, as the provider may own copyright in the respective software (or be an exclusive licensee).

The provider may provide services and equipment directly, or may use a subcontractor.

Once a recipient has completed its applicable transaction, and the system has been associated with at least one monitoring module, the recipient may be provided with the capability to track and monitor one or more characteristics or properties respective to an individual heat exchanger unit performance. Reported information (or parameters) may include percentage of fouling, time between warnings, cleaning frequency, etc). This information may be groupable by location or region to see if one is performing better than another. The system may also indicate them how many units are in green, yellow or red, which may further help identify problem regions, operators etc.

The method may further include a field service component. That is, the provider, or affiliated field service business, may be able to offer (give, etc.) a solution, whereby the monitored system sends out an alarm of some variation, such as SMS/text, email, etc. In this respect the recipient has the option to address the alarm, or have the provider tend to. In other words, in the event the monitored system provides a warning about, for example, a dirty radiator, the recipient is prompted to find a remedy that can alleviate or mitigate process downtime.

The business method may thus include steps pertaining to receiving a warning via the monitoring module, and selecting a remediation option, such as cleaning with dry ice or a pressure washer or in their yard when the pump comes back in from the field. In aspects, these steps may be handled remotely and/or off the jobsite. Accordingly, the recipient need not even have to take any action, as the provider may handle all steps.

The business method may include providing an incentivized transaction if the monitoring module is used with a HX unit that is sold by the provider. The monitoring module may have components as described herein, and the HX unit may likewise have components of any HX unit described herein.

Advantages

Embodiments of the disclosure advantageously provide for an improved heat exchanger unit useable with a wide array of heat generating devices.

Embodiments of the disclosure advantageously provide for new and innovative systems, hardware, software, and related methods, for monitoring a heat exchanger unit. An associated monitoring module may beneficially be retrofitted to existing equipment. Sensors of the module are configured for precision, and in conjunction with a microcontroller, are able together to accurately measure characteristics of a heat exchanger in real-time. In particular, the characteristic may be fouling. The ability to accurately warn of fouling alleviates the need for conventional and cumbersome remediation methods.

The heat exchanger unit of the disclosure may provide for the ability to reduce sound attributable to a point source, such as a fan. The fan may have a dominant acoustic frequency that may be reduced by at least 10 decibels. The heat exchanger unit may be configured with a particular baffle configuration that helps reduce sound. The baffles may be configured to have or contain a sound absorbing material. At the same time the baffle configuration may help drastically improve streamlined airflow, which further helps reduce sound emission and improves overall efficiency of the heat exchanger unit because of lowered power requirements.

The heat exchanger unit may advantageously provide for the ability to simultaneously cool multiple utility fluids in parallel. Advantages of the disclosure provide for a compact design with more heat transfer area in limited space, more heat transfer capability, reduced overall height by arranging heat exchanger cores at all four sides in general cube shape.

Embodiments of the disclosure advantageously provide for the ability to improve structural integrity of a heat exchanger unit. A radiator core of the unit may have an increased mass on a core end that may substantially prohibit or eliminate runoff of brazing material during a welding process.

The heat exchanger unit may provide for the ability to provide an 'absorber' effect with any thermal expansion. That is, one or more components may be coupled together via the use of a flex amount assembly, the assembly having a deformable member associated therewith. As thermal expansion occurs, the deformable member may deform resulting to absorb the expansion motion or stress.

Advantages herein may provide for a more convenient and realizable welding practice for core and tank, and a more convenient and flexible mount assembly.

While embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure presented herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of any claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A heat exchanger unit, comprising:
- a vertical axis;
- a frame comprising a top region, a bottom region, and a plurality of side regions;
- a first cooler coupled with the frame proximate to a respective side region and generally parallel to the vertical axis;
- a second cooler coupled with the frame proximate to the top region and generally perpendicular to the vertical axis;
- an inner airflow region within the heat exchanger unit; and
- a first baffle disposed within the inner airflow region, and at a first angle to the vertical axis.

2. The heat exchanger unit of claim 1, further comprising:
- a third cooler coupled with the frame proximate to the respective side region, and adjacent the first cooler; and
- a fourth cooler coupled with the frame proximate to the top region of the frame, and adjacent the second cooler.

3. The heat exchanger unit of claim 2, further comprising a second airflow region partitioned from the inner airflow region, wherein the second airflow region is associated with the third cooler and the fourth cooler, and wherein a second baffle is disposed within the second airflow region, and at a second angle to the vertical axis.

4. The heat exchanger unit of claim 3, wherein the first baffle and the second baffle comprise a sound absorbing material.

5. The heat exchanger unit of claim 4, further comprising a fan configured to operate and produce a point source dominant acoustic frequency, and wherein the sound absorbing material is capable to reduce the point source dominant acoustic frequency by at least 10 dB.

6. The heat exchanger unit of claim 5, wherein the sound absorbing material comprises mineral wool, and wherein each of the first angle and the second angle is in a range of about 30 to about 60 degrees.

7. The heat exchanger unit of claim 3, further comprising:
- a first fan mounted to the frame external to a first side of the first cooler; and
- a second fan mounted to the frame external to a first side of the second cooler,
- the first fan and the second fan each comprising an axis of rotation substantially perpendicular to the vertical axis.

8. The heat exchanger unit of claim 1, wherein the frame further comprises:
- a first sidewall;
- a second sidewall;
- a back wall; and
- a bottom.

9. The heat exchanger unit of claim 1, wherein at least one of a first sidewall, a second sidewall, a back wall, and a bottom further comprises: an inner layer of sound absorbing material; and an exterior layer of a vinyl-based material.

10. A blender skid for creating a frac fluid mixture, the comprising:
- a blender;
- a first diesel engine;
- a heat exchanger unit configured to cool at least one service fluid transferable between the heat exchanger unit and the first diesel engine, the heat exchanger unit further comprising:
  - a vertical axis;
  - a frame comprising a top region, a bottom region, and a plurality of side regions;
  - a first cooler coupled with the frame proximate to a respective side region and generally parallel to the vertical axis;
  - a second cooler coupled with the frame generally perpendicular to the orientation of the first cooler;

an inner airflow region within the heat exchanger unit; and a first baffle disposed within the inner airflow region, and at a first angle to the vertical axis.

11. The blender skid of claim 10, wherein the second cooler is coupled proximate to the top region.

12. The blender skid of claim 10, wherein the second cooler is coupled proximate to one of the plurality of side regions.

13. The blender skid of claim 10, wherein the heat exchanger unit further comprises a second baffle disposed therein at a second angle to the vertical axis, wherein the first angle and the second angle are in a range of 30 degrees to 60 degrees, and wherein the first baffle and the second baffle comprise a sound absorbing material.

14. The blender skid of claim 10, wherein the frame further comprises:

a first sidewall;

a second sidewall;

a back wall; and a bottom, wherein at least one of the first sidewall, the second sidewall, the back wall, and the bottom further comprises: an inner layer of sound absorbing material;

and an exterior layer of a vinyl-based material.

15. A heat exchanger unit, comprising:

a vertical axis;

a frame comprising a top region, a bottom region, and a plurality of side regions;

a first cooler coupled with the frame proximate to a respective side region and generally parallel to the vertical axis;

a second cooler coupled with the frame proximate to the top region and generally perpendicular to the vertical axis;

a first fan mounted to the frame external to a first side of the first cooler;

an inner airflow region within the heat exchanger unit; and a first baffle disposed within the inner airflow region, and at a first angle to the vertical axis.

16. The heat exchanger unit of claim 15, further comprising:

a third cooler coupled with the frame proximate to the respective side region, and adjacent the first cooler; and a fourth cooler coupled with the frame proximate to the top region of the frame, and adjacent the second cooler.

17. The heat exchanger unit of claim 16, further comprising a second airflow region partitioned from the inner airflow region, wherein the second airflow region is associated with the third cooler and the fourth cooler, and wherein a second baffle is disposed within the second airflow region, and at a second angle to the vertical axis.

18. The heat exchanger unit of claim 17, wherein the first baffle and the second baffle comprise a sound absorbing material.

19. The heat exchanger unit of claim 18, wherein the sound absorbing material comprises mineral wool, and wherein each of the first angle and the second angle is in a range of about 30 to about 60 degrees.

20. The heat exchanger unit of claim 15, wherein the frame further comprises:

a first sidewall;

a second sidewall;

a back wall; and a bottom, wherein at least one of the first sidewall, the second sidewall, the back wall, and the bottom further comprises: an inner layer of sound absorbing material;

and an exterior layer of a vinyl-based material.

* * * * *